US007210766B2

(12) United States Patent
Kuk et al.

(10) Patent No.: US 7,210,766 B2
(45) Date of Patent: May 1, 2007

(54) THERMALLY-DRIVEN INK-JET PRINTHEAD CAPABLE OF PREVENTING CAVITATION DAMAGE TO A HEATER

(75) Inventors: Keon Kuk, Yongin-si (KR); Seung-joo Shin, Seoul (KR); Dong-kee Sohn, Seoul (KR); Yong-soo Lee, Seoul (KR); Yong-soo Oh, Seongnam-si (KR); Ji-hyuk Lim, Suwon-si (KR); Seog-soon Baek, Suwon-si (KR); Mun-cheol Choi, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 195 days.

(21) Appl. No.: 10/874,740

(22) Filed: Jun. 24, 2004

(65) Prior Publication Data

US 2005/0012783 A1 Jan. 20, 2005

(30) Foreign Application Priority Data

Jun. 24, 2003 (KR) ..... 10-2003-0041226

(51) Int. Cl.
*B41J 2/05* (2006.01)

(52) U.S. Cl. ..... 347/56; 347/61

(58) Field of Classification Search ..... 347/61, 347/54, 56, 62

See application file for complete search history.

(56) References Cited

U.S. PATENT DOCUMENTS 4,514,741 A 4/1985 Meyer
4,882,595 A 11/1989 Trueba et al.
5,635,966 A * 6/1997 Keefe et al. ..... 347/43
6,019,457 A * 2/2000 Silverbrook ..... 347/65
6,886,919 B2 * 5/2005 Lim et al. ..... 347/56
2003/0001924 A1 1/2003 Chou et al.
2003/0085957 A1 5/2003 Huang et al.
2003/0090548 A1 5/2003 Min et al.
2003/0112294 A1 6/2003 Min et al.

FOREIGN PATENT DOCUMENTS

EP 1 188 475 A2 3/2002
EP 1 188 475 A3 3/2002

* cited by examiner

*Primary Examiner*—An H. Do
(74) *Attorney, Agent, or Firm*—Lee & Morse, P.C.

(57) ABSTRACT

A thermally-driven ink-jet printhead includes a substrate having an ink chamber to be filled with ink to be ejected, a manifold for supplying ink, and an ink channel for providing flow communication therebetween. First and second sidewalls are formed to a predetermined depth from an upper surface of the substrate and define the ink chamber to have a substantially rectangular shape. A nozzle plate including a plurality of material layers is formed on the substrate. A nozzle passes through the nozzle plate and is in flow communication with the ink chamber. A heater is disposed between the nozzle and one of the first sidewalls above the ink chamber. A conductor is electrically connected to the heater. The conductor and the heater are disposed within the nozzle plate. A shifting feature moves cavitation points beyond an outer edge of the heater.

40 Claims, 15 Drawing Sheets

THERMALLY-DRIVEN INK-JET PRINTHEAD CAPABLE OF PREVENTING CAVITATION DAMAGE TO A HEATER

BACKGROUND OF THE INVENTION

1. Field of the Invention

The present invention relates to an ink-jet printhead. More particularly, the present invention relates to a thermally-driven ink-jet printhead having an improved structure that is capable of preventing cavitation damage to a heater.

2. Description of the Related Art

In general, ink-jet printheads are devices for printing a predetermined image, color or black, by ejecting a small volume droplet of ink at a desired position on a recording sheet. Ink-jet printheads are generally categorized into two types depending on which ink ejection mechanism is used. A first type is a thermally-driven ink-jet printhead in which a source of heat is employed to form and expand bubbles in ink to cause an ink droplet to be ejected due to the expansive force of the formed bubble. A second type is a piezoelectrically-driven ink-jet printhead, in which an ink droplet is ejected by a pressure applied to the ink and a change in ink volume due to a deformation of a piezoelectric element.

An ink droplet ejection mechanism of a thermal ink-jet printhead will now be explained in detail. When a pulse current is applied to a heater, which includes a heating resistor, the heater generates heat and ink near the heater is instantaneously heated to approximately 300° C., thereby boiling the ink. The boiling of the ink causes bubbles to be generated, and exert pressure on ink filling an ink chamber. As a result, ink around a nozzle is ejected from the ink chamber in the form of a droplet through the nozzle.

A thermal ink-jet printhead is classified into a top-shooting type, a side-shooting type, and a back-shooting type depending on a bubble growing direction and a droplet ejection direction. In a top-shooting type of printhead, bubbles grow in the same direction in which ink droplets are ejected. In a side-shooting type of printhead, bubbles grow in a direction perpendicular to a direction in which ink droplets are ejected. In a back-shooting type of printhead, bubbles grow in a direction opposite to a direction in which ink droplets are ejected.

An ink-jet printhead using the thermal driving method should satisfy the following requirements. First, manufacturing of the ink-jet printheads should be simple, costs should be low, and should facilitate mass production thereof. Second, in order to obtain a high-quality image, cross talk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after ink has been ejected from the ink chamber should be as short as possible and the cooling of heated ink and heater should be performed quickly to increase a driving frequency.

FIG. 1 illustrates a partial cut-away perspective view of a conventional thermally-driven ink-jet printhead. FIG. 2 illustrates a cross-sectional view of the conventional thermally-driven ink-jet printhead shown in FIG. 1.

The ink-jet printhead shown in FIG. 1 includes a base plate 10 formed of a plurality of material layers stacked on a substrate, a passage plate 20, which is stacked on the base plate 10 and forms an ink chamber 22 and an ink passage 24, and a nozzle plate 30 stacked on the passage plate 20. Ink is filled in the ink chamber 22, and a heater (13 of FIG. 2) for generating bubbles by heating ink is disposed below the ink chamber 22. The ink passage 24 is a path through which ink is supplied to the ink chamber 22 and which provides flow communication from an ink reservoir (not shown). A plurality of nozzles 32, through which ink is ejected, is formed at a position of the nozzle plate 30 corresponding to each ink chamber 22.

The vertical structure of the conventional inkjet printhead having the above structure will now be described with reference to FIG. 2.

Referring to FIG. 2, an insulating layer 12 is formed on a substrate 11 formed of silicon, to provide insulation between a heater 13 and the substrate 11. The insulating layer 12 is formed by depositing a silicon oxide layer on the substrate 11. The heater 13 for generating a bubble 42 by heating ink 41 in an ink chamber 22 is formed on the insulating layer 12. The heater 13 is formed by depositing tantalum nitride (TaN) or a tantalum-aluminum (TaAl) alloy on the insulating layer 12 in a thin film shape. A conductor 14 for applying current to the heater 13 is formed on the heater 13. The conductor 14 is made of aluminum or aluminum alloy.

A passivation layer 15 for protecting the heater 13 and the conductor 14 is formed on the heater 13 and the conductor 14. The passivation layer 15 prevents the heater 13 and the conductor 14 from oxidizing or directly contacting the ink 41, and is formed by depositing silicon nitride. In addition, an anti-cavitation layer 16, on which the ink chamber 22 is to be formed, is formed on the passivation layer 15. The anti-cavitation layer 16 is formed of metal, e.g., tantalum (Ta).

A passage plate 20 for forming the ink chamber 22 and the ink passage 24 is stacked on a base plate 10 formed of a plurality of material layers stacked on the substrate 11. A nozzle plate 30 having a nozzle 32 is stacked on the passage plate 20.

In the above structure, if a pulse current is supplied to the heater 13 and heat is generated by the heater 13, the ink 41 filling the ink chamber 22 boils, and a bubble 42 is generated. The bubble 42 expands continuously and applies pressure to the ink 41 in the ink chamber 22. As a result, an ink droplet 41' is ejected through the nozzle 32.

In the above-described conventional thermally-driven ink-jet printhead, however, a supply of energy from the heater 13 is interrupted, and heat is dissipated to the ink 41 around the bubble 42. As a result, the expanding bubble 42 contracts rapidly. When the bubble 42 contracts and collapses in this manner, a very high pressure is applied to a portion of the ink chamber 22 where the bubble 42 finally collapses. As a result, the heater 13 and the passivation layer 15 covering the heater 13 in the vicinity of the collapse are damaged. This damage is referred to as cavitation damage, and points where the bubble 42 collapses, i.e., points where the cavitation damage occurs, are referred to as cavitation points. Cavitation damage occurs repeatedly during every ejection cycle and becomes severe. As a result, the formation of the bubble 42 varies, the reliability of normal operation of a printhead decreases, and the lifespan of the printhead is shortened.

Conventionally, in order to protect the heater 13 and the passivation layer 15 from cavitation damage, a thick anti-cavitation layer 16 is stacked above the heater 13. However, in this case, more energy is required to heat the ink 41 in the ink chamber 22. As a result, the printhead is overheated, which adversely affects a driving frequency of the printhead.

A variety of heater structures have been recently proposed to prevent problems related to cavitation damage. Two examples of such heater structures are shown in FIGS. 3 and 4. FIG. 3 illustrates a plan view of an example of a conventional heater structure for preventing cavitation damage. FIG. 4 illustrates a plan view of another example of a conventional heater structure for preventing cavitation damage.

Referring to FIG. 3, a conductor 57 is connected to opposite sides of a heater 50 formed on a silicon substrate 55. A conductive area 53, formed of a metallic conductive material, is formed at a center of the heater 50. Resultantly, a bubble is not generated at a central area of the heater 50, but rather a ring-shaped bubble is formed at a peripheral area of the heater 50. The ring-shaped bubble contracts and collapses in such a way that a cavitation shock is dispersed to a surface of the heater 50. However, even though the cavitation shock is dispersed to the surface of the heater 50, if the cavitation shock is repeatedly applied to the surface of the heater 50, damage to the heater 50 cannot be avoided. In addition, in order to eject an ink droplet having a predetermined amount of ink, i.e., a predetermined volume, a bubble corresponding to the predetermined amount of ink is required. Since the bubble is not generated at the central area of the heater 50, the entire size of the heater 50 is required to increase. As a result, a size of an ink chamber increases, which results in poor fluid, i.e., ink, movement, thereby making it difficult to increase a driving frequency.

In FIG. 4, conductors 65 and 66 are connected to both sides of a heater 62. A hollow portion 70 is formed at a center of the heater 62. Accordingly, the heater 62 has a ring shape to surround the hollow portion 70, and a bubble is not generated in the hollow portion 70. However, current does not uniformly flow through the ring-shaped heater 62. Thus, an amount of heat generation is not constant. In addition, since the entire size of the heater 62 significantly increases to permit the formation of the hollow portion 70, it is again difficult to increase a driving frequency, as in the heater shown in FIG. 3.

SUMMARY OF THE INVENTION

The present invention is therefore directed to a thermal ink-jet printhead having an improved structure, which substantially overcomes one or more of the problems due to the limitations and disadvantages of the related art.

It is a feature of an embodiment of the present invention to provide a thermally-driven ink-jet printhead having an ink chamber having an improved structure in which cavitation points are located at positions beyond a heater to prevent cavitation damage to the heater.

It is another feature of an embodiment of the present invention to provide a thermally-driven ink-jet printhead having an improved structure in which a heater includes a metallic layer formed at cavitation points to prevent cavitation damage to the heater.

At least one of the above features and other advantages may be provided by an ink-jet printhead including a substrate having an ink chamber to be filled with ink to be ejected, a manifold for supplying ink to the ink chamber, and an ink channel for providing flow communication between the ink chamber and the manifold, first sidewalls and second sidewalls, which are formed to a predetermined depth from an upper surface of the substrate and define the ink chamber to have a substantially rectangular shape, the first sidewalls being disposed in a widthwise direction of the ink chamber and the second sidewalls being disposed in a lengthwise direction of the ink chamber, a nozzle plate formed on the substrate, the nozzle plate including a plurality of material layers, and a nozzle passing through the nozzle plate and in flow communication with the ink chamber, a heater, which is disposed between the nozzle and one of the first sidewalls, the heater being disposed within the nozzle plate and positioned above the ink chamber, a conductor, which is disposed within the nozzle plate, the conductor being electrically connected to the heater, and a shifting feature for moving cavitation points beyond an outer edge of the heater.

In an embodiment of the present invention, inner surfaces of each of the first sidewalls may be uneven. For example, a plurality of convex projections or a plurality of concave grooves may be formed on the inner surfaces of each of the first sidewalls.

In another embodiment of the present invention, a pocket may be formed in each of the first sidewalls. In this case, inner surfaces of the pocket may be uneven. For example, a plurality of convex projections or a plurality of concave grooves may be formed on the inner surfaces of each of the first sidewalls.

In either of the above embodiments, the heater may have a substantially rectangular shape in which the length of a widthwise direction of the ink chamber is large. The ink channel may include two ink channels, each of the two ink channel being formed adjacent to one of the first sidewalls.

In still another embodiment of the present invention, the printhead may include a main heater, which is disposed between the nozzle and one of the first sidewalls, the main heater being disposed within the nozzle plate and positioned above the ink chamber, an auxiliary heater, which is disposed between the main heater and a corresponding one of the first sidewalls, a conductor, which is disposed within the nozzle plate, the conductor being electrically connected to the main heater and the auxiliary heater.

A size of the auxiliary heater and a distance between the auxiliary heater and the main heater may be determined so that cavitation points are located between the main heater and the auxiliary heater. The main heater and the auxiliary heater may have a substantially rectangular shape in which the length of a widthwise direction of the ink chamber is large. Dimensions of the auxiliary heater may be determined so that a resistance of the auxiliary heater is the same as a resistance of the main heater. The main heater and the auxiliary heater may be both connected to the conductor.

In yet another embodiment of the present invention, the printhead may further include a metallic layer, which is formed at a center of a lengthwise direction of the heater. In this embodiment, the heater may be divided into two parts so that each part has a length that is one-half the length of the undivided heater, and the metallic layer is formed between the two parts. The metallic layer may be formed on a bottom surface of the lengthwise center at an outer edge of the heater. The metallic layer may be formed to have a wedge shape.

In any of the above embodiments, the first sidewalls and the second sidewalls define the ink chamber to have a substantially rectangular shape in which a length is larger than a width. The first sidewalls and the second sidewalls may be formed of materials other than a material used to form the substrate. The first sidewalls and the second sidewalls may be silicon oxide.

The nozzle plate may include a plurality of passivation layers stacked on the substrate and a heat dissipating layer stacked on the plurality of passivation layers, the heat dissipating layer being formed of a material having good thermal conductivity. The plurality of passivation layers may be formed of an insulating material. The heater and the conductor may be formed between adjacent layers of the plurality of passivation layers.

The nozzle may have a tapered shape such that a diameter thereof decreases in a direction toward an outlet.

The heat dissipating layer may be formed of at least one material selected from the group consisting of nickel (Ni), copper (Cu), aluminum (Al), and gold (Au). The heat dissipating layer may be formed to a thickness of about 10–100 μm. The heat dissipating layer may thermally contact an upper surface of the substrate through a contact hole formed in the plurality of passivation layers.

Any of the above embodiments may further include a seed layer, for electroplating the heat dissipating layer, formed on the plurality of passivation layers. The seed layer may be formed of at least one material selected from the group consisting of copper (Cu), chromium (Cr), titanium (Ti), gold (Au), and nickel (Ni).

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
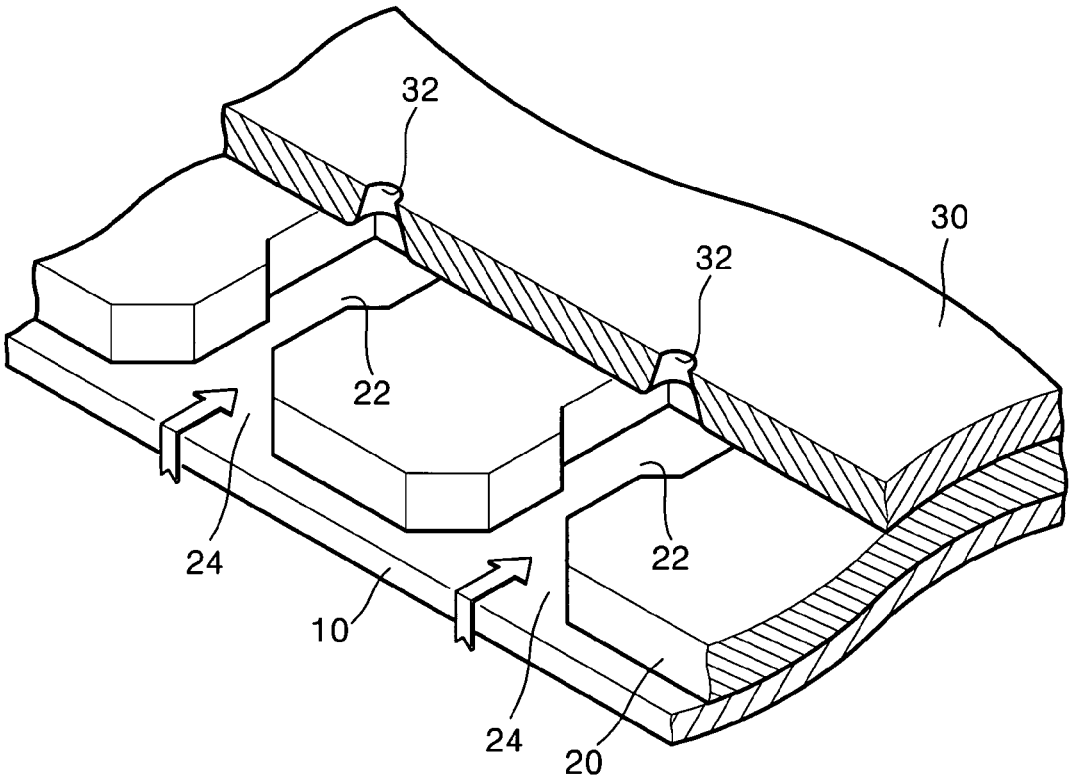
FIG. 1 (PRIOR ART)
FIG. 1 illustrates a partial cut-away perspective view of an example of a conventional thermally-driven ink-jet printhead.
Figure 2:
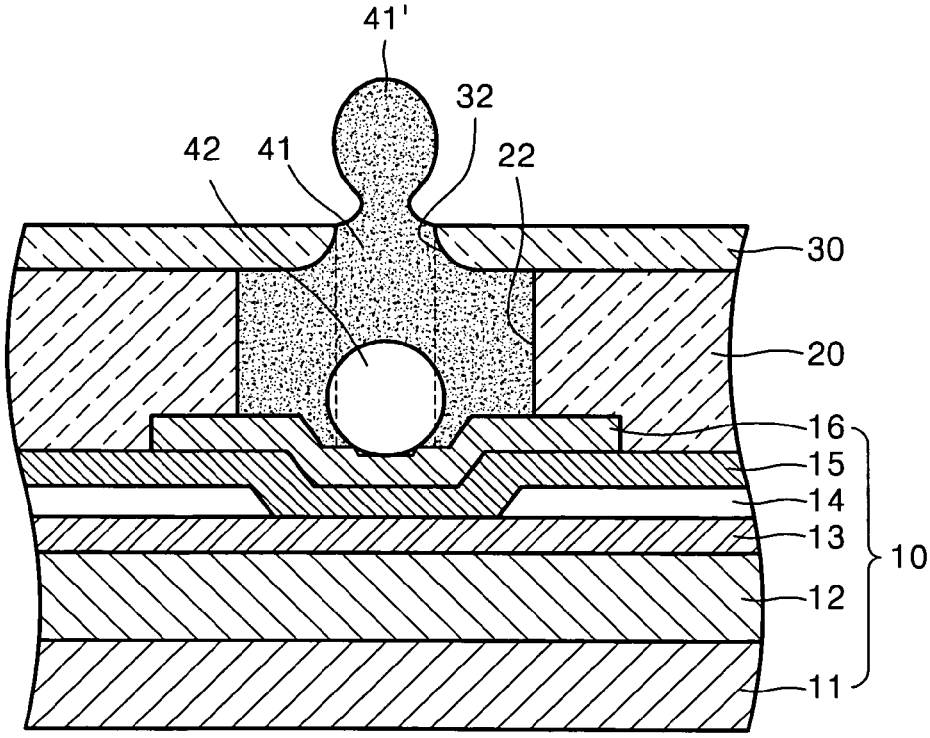
FIG. 2 (PRIOR ART)
FIG. 2 illustrates a cross-sectional view of the vertical structure of the conventional thermally-driven ink-jet printhead shown in FIG. 1.
Figure 3:
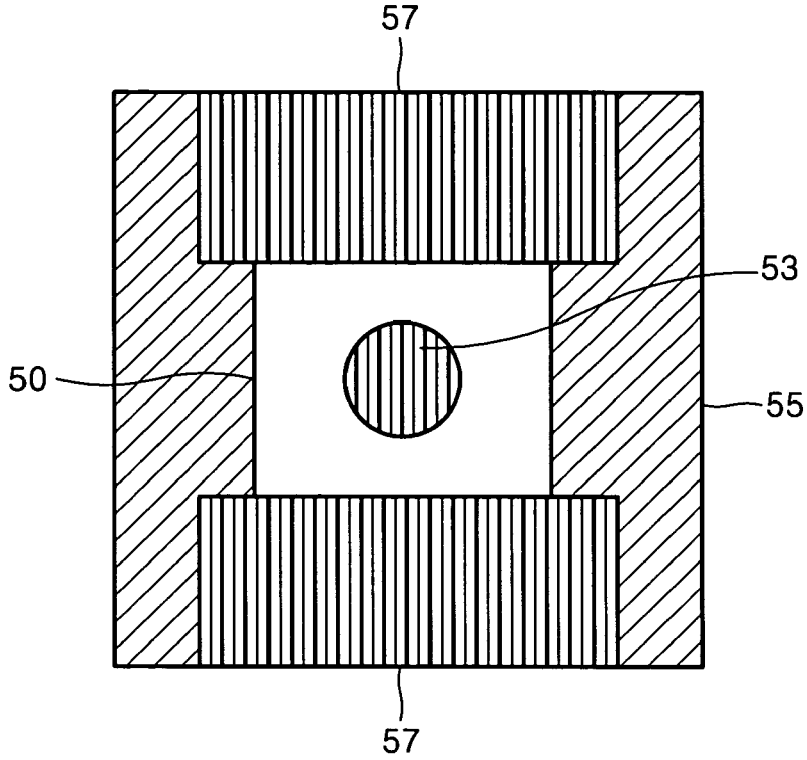
FIG. 3 (PRIOR ART)
FIG. 3 illustrates a plan view of an example of a conventional heater structure for preventing cavitation damage.
Figure 4:
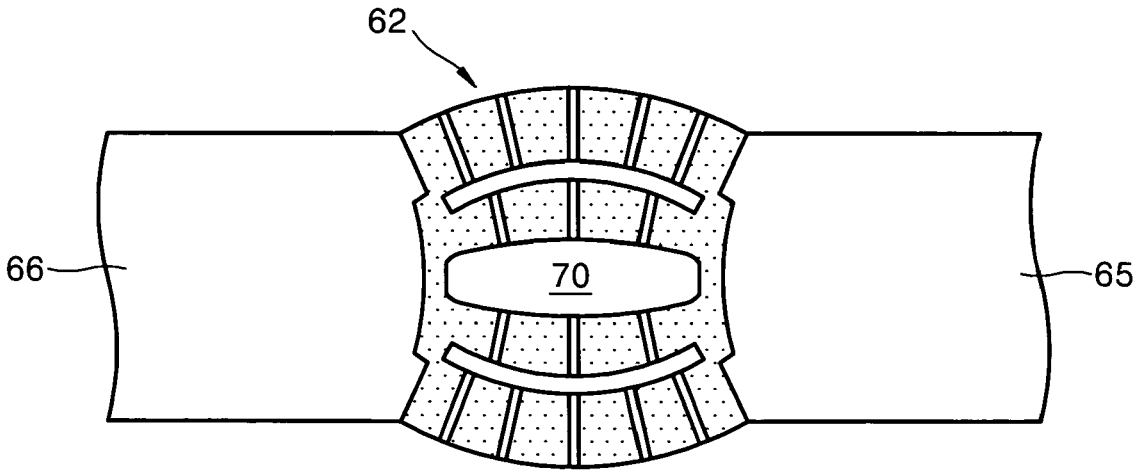
FIG. 4 (PRIOR ART)
FIG. 4 illustrates a plan view of another example of a conventional heater structure for preventing cavitation damage.

Korean Patent Application No. 2003-41226, filed on Jun. 24, 2003, in the Korean Intellectual Property Office, and entitled: "Thermally-Driven Ink-Jet Printhead Without Cavitation Damage of Heater," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 5:
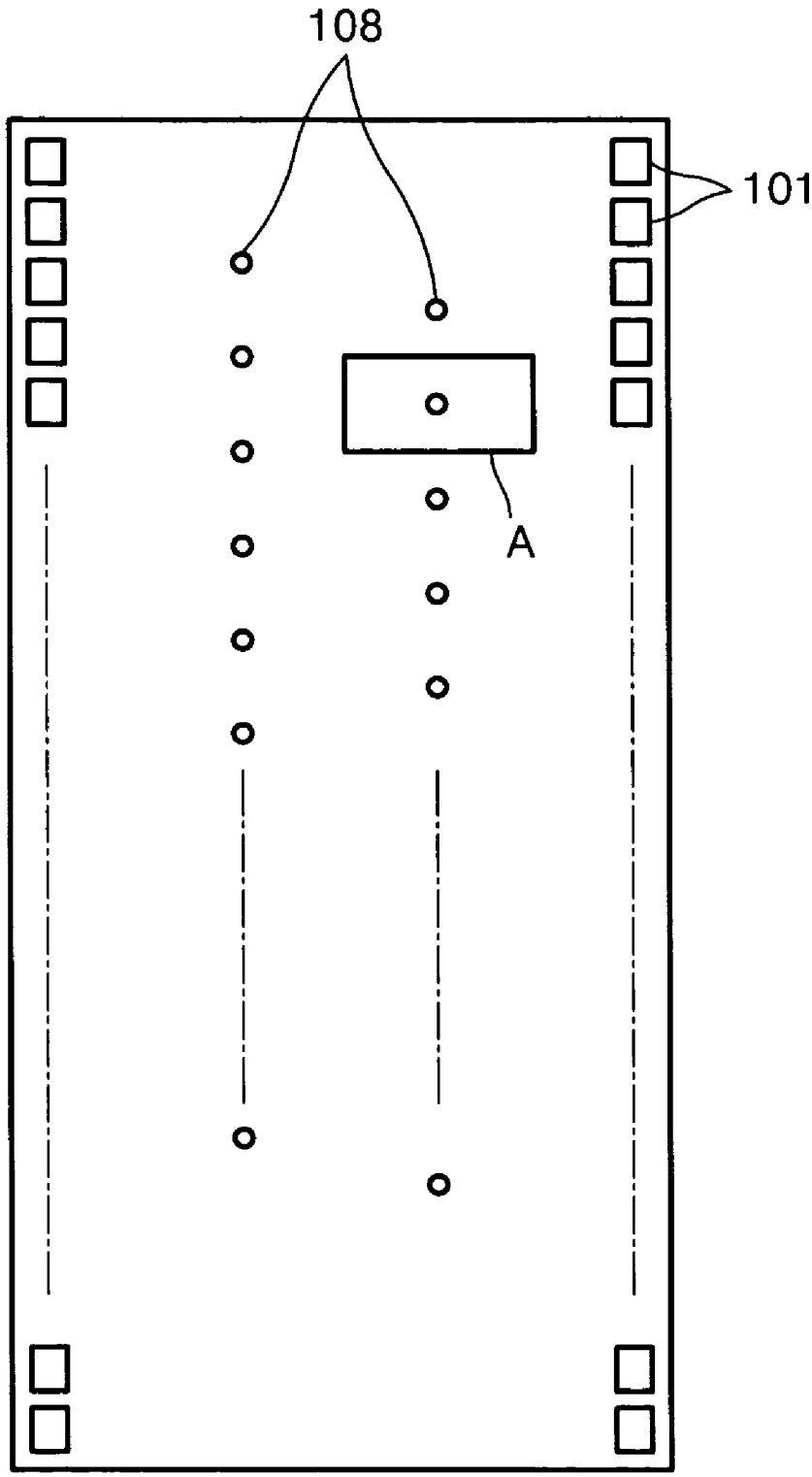
FIG. 5 schematically illustrates a plan view of a thermally-driven ink-jet printhead according to the present invention.

FIG. 5 schematically illustrates a plan view of a thermally-driven ink-jet printhead according to the present invention. Referring to FIG. 5, a plurality of nozzles 108 are exemplarily disposed in two rows on a surface of the ink-jet printhead manufactured in a chip state, and bonding pads 101, which can be bonded to wires, are disposed at edges of the surface of the ink-jet printhead. In alternative embodiments, the nozzles 108 may be disposed in a single row, or in three or more rows to improve printing resolution.

Figure 6:
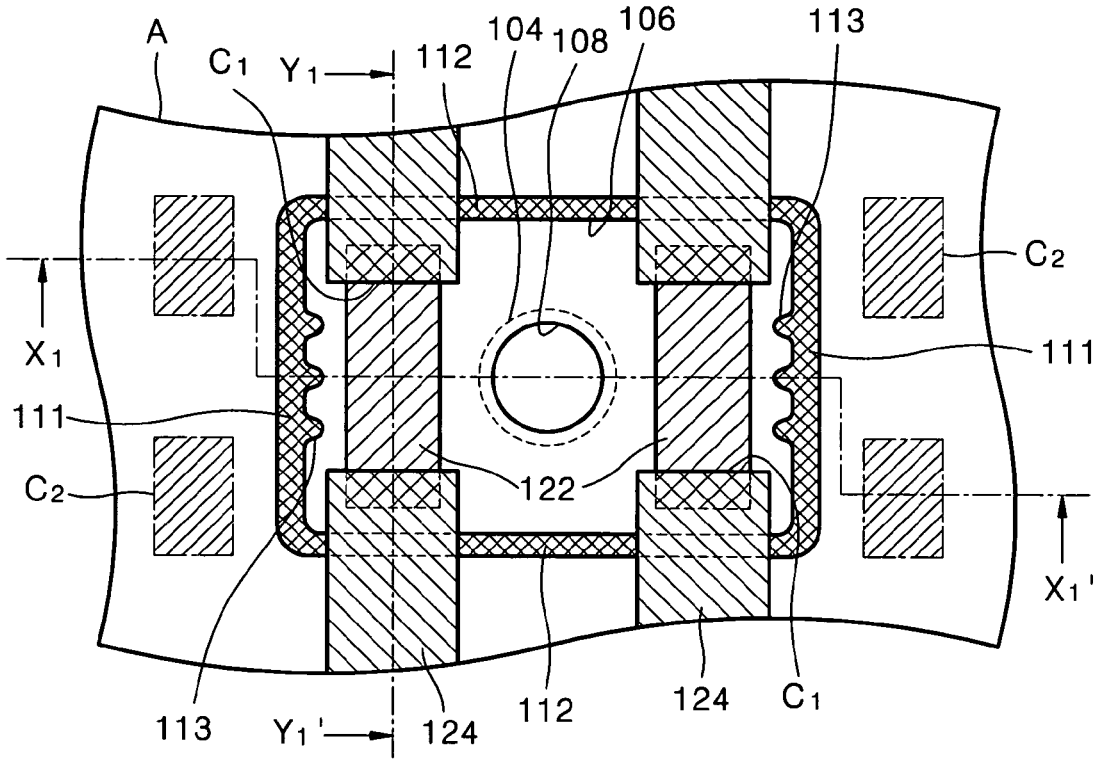
FIG. 6 illustrates an enlarged plan view of a portion "A" of FIG. 5 of the ink-jet printhead according to a first embodiment of the present invention.
Figure 7:
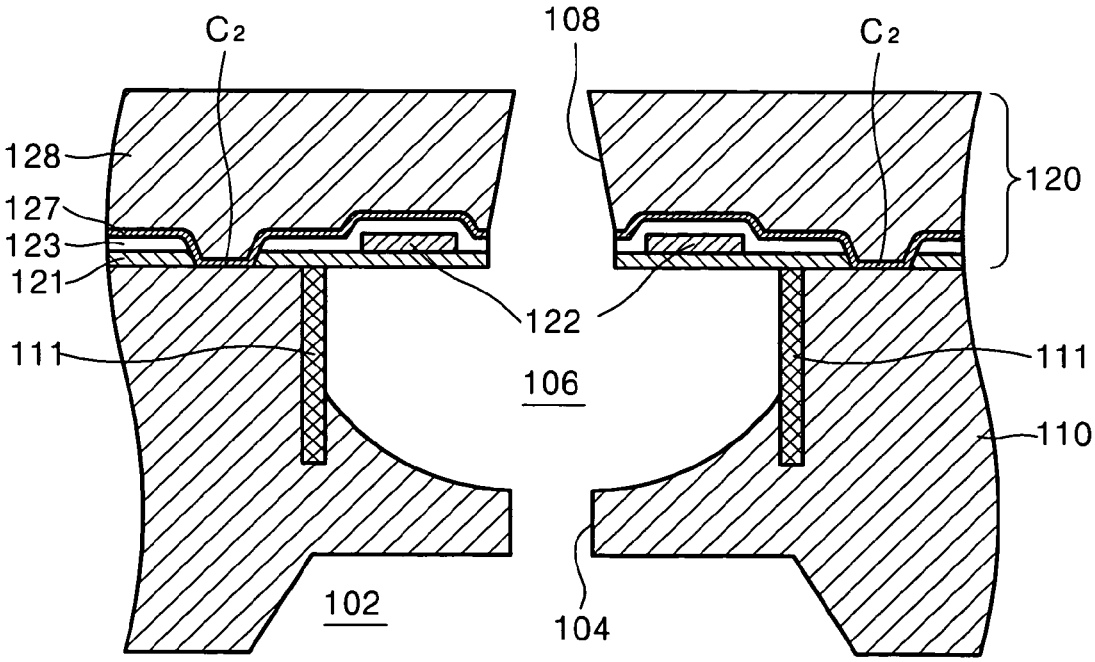
FIGS. 7 and 8 illustrate cross-sectional views of the ink-jet printhead taken along lines $X_1$–$X_1$' and $Y_1$–$Y_1$' of FIG. 6.
Figure 8:
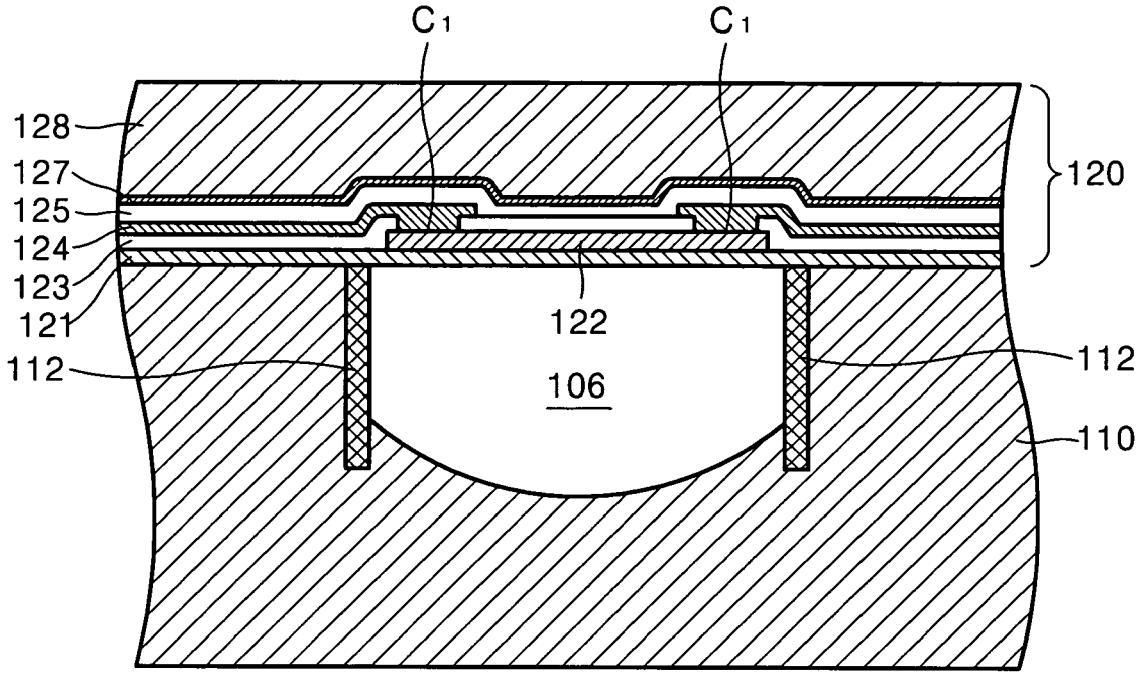

FIG. 6 illustrates an enlarged plan view of a portion "A" of FIG. 5 of an ink-jet printhead according to a first embodiment of the present invention. FIGS. 7 and 8 illustrate cross-sectional views of the ink-jet printhead according to the first embodiment of the present invention taken along lines $X_1$–$X_1$' and $Y_1$–$Y_1$' of FIG. 6.

Referring to FIGS. 6 through 8, the ink-jet printhead includes an ink passage including a manifold 102, an ink channel 104, an ink chamber 106, and a nozzle 108.

The manifold 102 is formed on a lower surface of a substrate 110 and is in flow communication with an ink reservoir (not shown) for storing ink. Thus, the manifold 102 supplies ink to the ink chamber 106 from the ink reservoir. The manifold 102 may be formed by wet etching or anisotropically dry etching the lower surface of the substrate 110.

Silicon wafers widely used to manufacture semiconductor devices, may be used for the substrate 110.

In FIG. 7, it may be seen that the ink channel 104 is vertically formed through the substrate 110 between the ink chamber 106 and the manifold 102. In alternative arrangements, the ink channel 104 may be formed at a position corresponding to a center of the ink chamber 106, at an edge of the ink chamber 106, or at any position providing flow communication between the ink chamber 106 and the manifold 102. The ink channel 104 may have a variety of cross-sectional shapes, such as a circular shape and a polygonal shape. In addition, one or more ink channels 104 may be formed in consideration of a desired ink supply speed. The ink channel 104 may be formed by dry etching the substrate 110 between the manifold 102 and the ink chamber 106 through reactive ion etching (RIE).

The ink chamber 106 to be filled with ink is formed on an upper surface of the substrate 110 to a predetermined depth, e.g., 10–80 μm. The ink chamber 106 is defined by two sidewalls 111 and 112 that surround the ink chamber 106. The sidewalls 111 and 112 may be formed to define the ink chamber 106 to have a substantially rectangular shape, e.g., a substantially rectangular shape in which a width in a nozzle disposition direction is small and a length in a direction perpendicular to the nozzle disposition direction is large, or vice versa. The nozzle disposition direction may be as shown in FIG. 5. The sidewalls 111 and 112 include first sidewalls 111 formed in a widthwise direction of the ink chamber 106, a distance therebetween defining the length of the ink chamber 106 and second sidewalls 112 formed in a lengthwise direction of the ink chamber 106, a distance therebetween defining a width of the ink chamber 106.

Because the width of the ink chamber 106 is defined by the distance between the second sidewalls 112 to be comparatively small, a distance between adjacent nozzles 108 can be narrowed. As a result, a plurality of nozzles 108 can be densely disposed, resulting in realization of an ink-jet printhead having high DPI that is capable of printing a high resolution image.

In the first embodiment of the present invention, inner surfaces of the first sidewalls 111 are uneven. Specifically, each of the first sidewalls 111 has at least one, or, more preferably, a plurality of, convex projection 113. As a result, a surface area of the inner surfaces of the first sidewalls 111 adjacent to a bubble formed in the ink chamber 106 increases, so that cavitation points move beyond outer edges of heaters 122 toward the first sidewalls 111. This operation will be subsequently described in further detail.

The first and second sidewalls 111 and 112 are formed of materials other than a material used to form the substrate 110. This selection is necessary because the ink chamber 106 is formed by isotropically etching the substrate 110 using the first and second sidewalls 111 and 112 as an etch stop. Thus, when the substrate 110 is formed of a silicon wafer, the first and second sidewalls 111 and 112 may be formed of silicon oxide.

The first and second sidewalls 111 and 112 may be formed by forming a trench to a predetermined depth by etching an upper surface of the substrate 110 and then filling the trench with silicon oxide. The ink chamber 106 may be formed by isotropically etching the substrate 110 defined by the first and second sidewalls 111 and 112, through the nozzle 108, which will be described later. In this case, since the first and second sidewalls 111 and 112 serve as an etch stop, the side surfaces of the ink chamber 106 are defined by the first and second sidewalls 111 and 112, and the bottom surface of the ink chamber 106 is a substantially curved surface due to the isotropical etching of the substrate 110.

Accordingly, the ink chamber 106 can be very accurately formed by the first and second sidewalls 111 and 112 to have specified dimensions. Specifically, the ink chamber 106 may have an optimum volume at which ink required for ejection of ink droplets having a designed volume is stored.

A nozzle plate 120 is disposed on the upper surface of the substrate 110, in which the ink chamber 106, the ink channel 104, and the manifold 102 are formed. The nozzle plate 120 forms an upper wall of the ink chamber 106. A nozzle 108, through which ink is ejected from the ink chamber 106, is vertically formed through the nozzle plate 120 at a position corresponding to a center of the ink chamber 106.

The nozzle plate 120 is formed of a plurality of material layers stacked on the substrate 110. The plurality of material layers includes first, second, and third passivation layers 121, 123, and 125. The material layers may further include a heat dissipating layer 128. The heaters 122 and conductors 124, which are electrically connected to the heaters 122, are disposed between the passivation layers 121, 123, and 125.

The first passivation layer 121 is a lowermost material layer of the plurality of material layers, which are components of the nozzle plate 120, and is formed on the upper surface of the substrate 110. The first passivation layer 121 is formed to provide insulation between the heaters 122 and the substrate 110 and to protect the heaters 122. The first passivation layer 121 may be formed by depositing silicon oxide or silicon nitride on the upper surface of the substrate 110.

The heaters 122, which heat ink in the ink chamber 106, are disposed on the first passivation layer 121, and formed on the ink chamber 106. The heaters 122 are disposed at opposite sides of the nozzle 108, i.e., between the nozzle 108 and the two first sidewalls 111. The heaters 122 may have a substantially rectangular shape, e.g., a substantially rectangular shape having a longer side parallel to the first sidewalls 111. The heaters 122 may be formed by depositing a resistive heating material, such as impurity-doped polysilicon, tantalum-aluminum alloy, tantalum nitride, titanium nitride, or tungsten silicide, on the entire surface of the first passivation layer 121 to a predetermined thickness of about 0.05–1.0 μm and patterning the deposited material in a predetermined shape, e.g., in a substantially rectangular shape.

If the substantially rectangular heaters 122 are formed at opposite sides of the nozzle 108, cavitation points caused by the collapse of a bubble generated below the heaters 122 move beyond an outer edge of the heaters 122 toward the adjacent first sidewalls 111. This phenomenon will be subsequently described in further detail.

The second passivation layer 123 is formed on the first passivation layer 121 and the heaters 122. The second passivation layer 123 is formed to provide insulation between the heat dissipating layer 128 formed thereon and the heaters 122 formed thereunder. The second passivation layer 123 may be formed by depositing silicon nitride or silicon oxide to a thickness of about 0.2–1 μm, which is similar to the first passivation layer 121.

The conductors 124, each of which being electrically connected to one of the heaters 122 to deliver a pulse current to a corresponding heater 122, are formed on the second passivation layer 123. Each conductor 124 is connected to both ends of a corresponding heater 122 via a first contact hole $C_1$ formed in the second passivation layer 123. The conductor 124 may be formed by depositing material having good conductivity, e.g., aluminum (Al), aluminum alloy, gold (Au), or silver (Ag) to a thickness of about 0.5–2 μm by sputtering and patterning the deposited material.

The third passivation layer 125 is formed on the conductor 124 and the second passivation layer 123. The third passivation layer 125 is formed to provide insulation between the conductor 124 formed thereunder and the heat dissipating layer 128 formed thereon. The third passivation layer 125 may be formed by depositing tetraethylorthosilicate (TEOS) oxide, silicon oxide, or silicon nitride to a thickness of about 0.7–3 μm. Preferably, the third passivation layer 125 is formed within a range in which an insulation function thereof is not compromised. Further, the third passivation layer 125 is formed on an upper portion of the conductor 124 and at portions adjacent thereto and is not formed at the remaining portions as possible, e.g., on upper portions of the heaters 122. This arrangement is necessary because a distance between the heat dissipating layer 128 and the heaters 122 and a distance between the heat dissipating layer 128 and the substrate 110 are narrowed to further improve the heat dissipating capability of the heat dissipating layer 128.

The conductor 124 may be formed on the first passivation layer 121 and may be directly connected to the heaters 122. In this case, the second passivation layer 123 is formed on the heaters 122, the conductor 124, and the first passivation layer 121, and the third passivation layer 125 may be omitted.

The heat dissipating layer 128 is formed on the third passivation layer 125 and the second passivation layer 123 and thermally contacts the upper surface of the substrate 110 via a second contact hole $C_2$ formed through the second passivation layer 123 and the first passivation layer 121. The heat dissipating layer 128 may be formed of a material having good thermal conductivity, such as nickel (Ni), copper (Cu), aluminum (Al), or gold (Au). In addition, the heat dissipating layer 128 may be formed of one or more metallic layers. The heat dissipating layer 128 may be formed to a relatively large thickness of about 10–100 μm by electroplating the above-described metallic material on the third passivation layer 125 and the second passivation layer 123. To this end, a seed layer 127 for electroplating the above-described metallic material may be formed on the third passivation layer 125 and the second passivation layer 123. The seed layer 127 may be formed of a metallic material having good electrical conductivity, such as copper (Cu), chromium (Cr), titanium (Ti), gold (Au), or nickel (Ni) to a thickness of about 500–3000 Å by sputtering. The seed layer 127 may also be formed of one or more metallic layers.

As described above, when the heat dissipating layer 128 is formed by electroplating, the heat dissipating layer 128 may be formed integrally with the other elements of the ink-jet printhead and may be formed to a relatively large thickness so that heat can be dissipated effectively.

The heat dissipating layer 128 dissipates heat generated by the heaters 122 and remaining around the heaters 122 while thermally contacting the upper surface of the substrate 110 via the second contact hole $C_2$. Specifically, heat generated by the heaters 122 and remaining around the heaters 122 after ink is ejected is dissipated to the substrate 110 and out of the printhead via the heat dissipating layer 128. Thus, heat is dissipated more quickly after ink is ejected so that printing can be performed stably at a high driving frequency.

As described above, since the heat dissipating layer 128 may be formed to a relatively large thickness, the nozzle 108 can be formed to have a sufficient length. Thus, a stable high-speed operation can be performed, and linearity of ink droplets ejected through the nozzle 108 is improved. That is, the ink droplets can be ejected in a direction exactly perpendicular to the substrate 110.

The nozzle 108 is formed through the nozzle plate 120. Preferably, as shown in FIG. 7, the nozzle 108 may have a tapered shape such that a diameter thereof decreases in a direction toward an outlet. Since the nozzle 108 has a tapered shape, a meniscus at the surface of ink in the nozzle 108 is more quickly stabilized after ink is ejected. The nozzle 108 may be formed by sequentially etching the third through first passivation layers 125, 123, and 121, e.g., through reactive ion etching (RIE), forming a plating mold to have the shape of a nozzle using a photoresist or photosensitive polymer, forming the heat dissipating layer 128 by electroplating, and then removing the plating mold.

Figure 9:
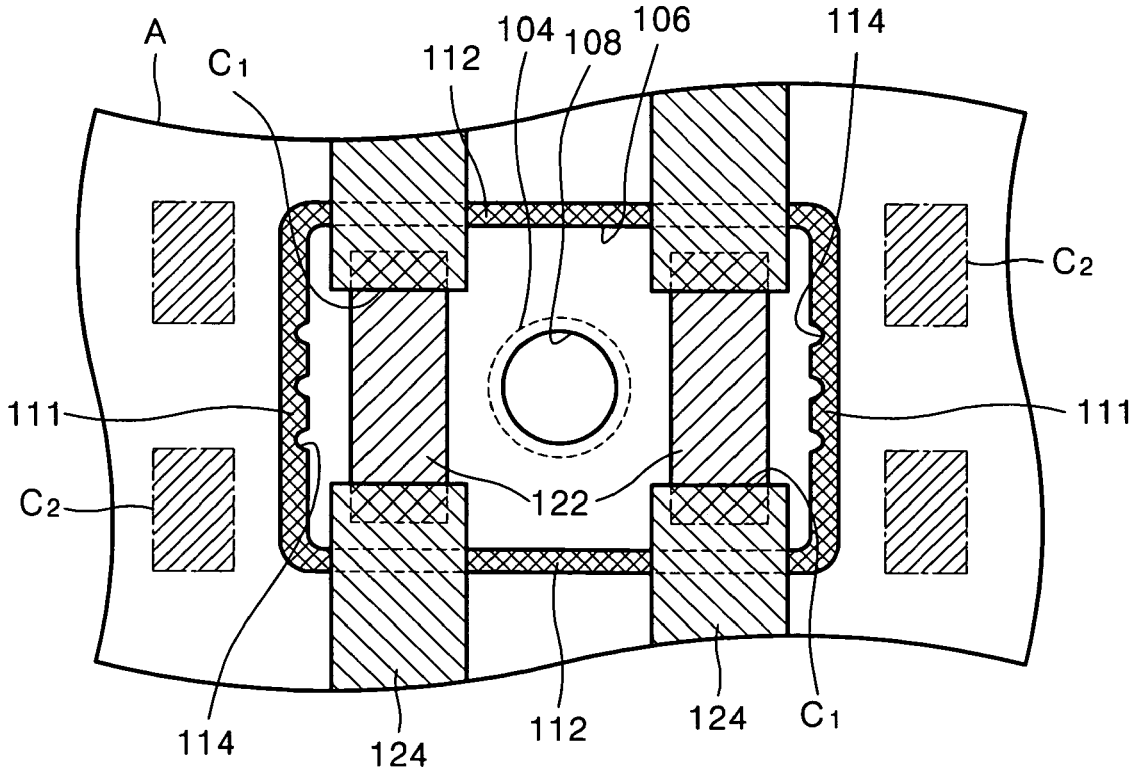
FIG. 9 illustrates a plan view of a modified example of a first sidewall of the ink-jet printhead shown in FIG. 6.

FIG. 9 illustrates a plan view of a modified example of a first sidewall of the ink-jet printhead shown in FIG. 6.

The structure of the ink-jet printhead shown in FIG. 9 is substantially the same as the structure of the ink-jet pirnthead shown in FIG. 6 except for a shape of inner surfaces of the first sidewalls 111. The structure of the ink-jet printhead shown in FIG. 9 is the same as the structure of the ink-jet printhead shown in FIGS. 7 and 8.

Referring to FIG. 9, the first sidewalls 111 that surround the ink chamber 106 have at least one, or, more preferably, a plurality of, concave groove 114. Since a surface area of the inner surfaces of the first sidewalls 111 increases due to the concave grooves 114, which is similar to the printhead shown in FIG. 6, cavitation points move beyond outer edges of the heaters 122 and toward the first sidewalls 111.

Figure 10A:
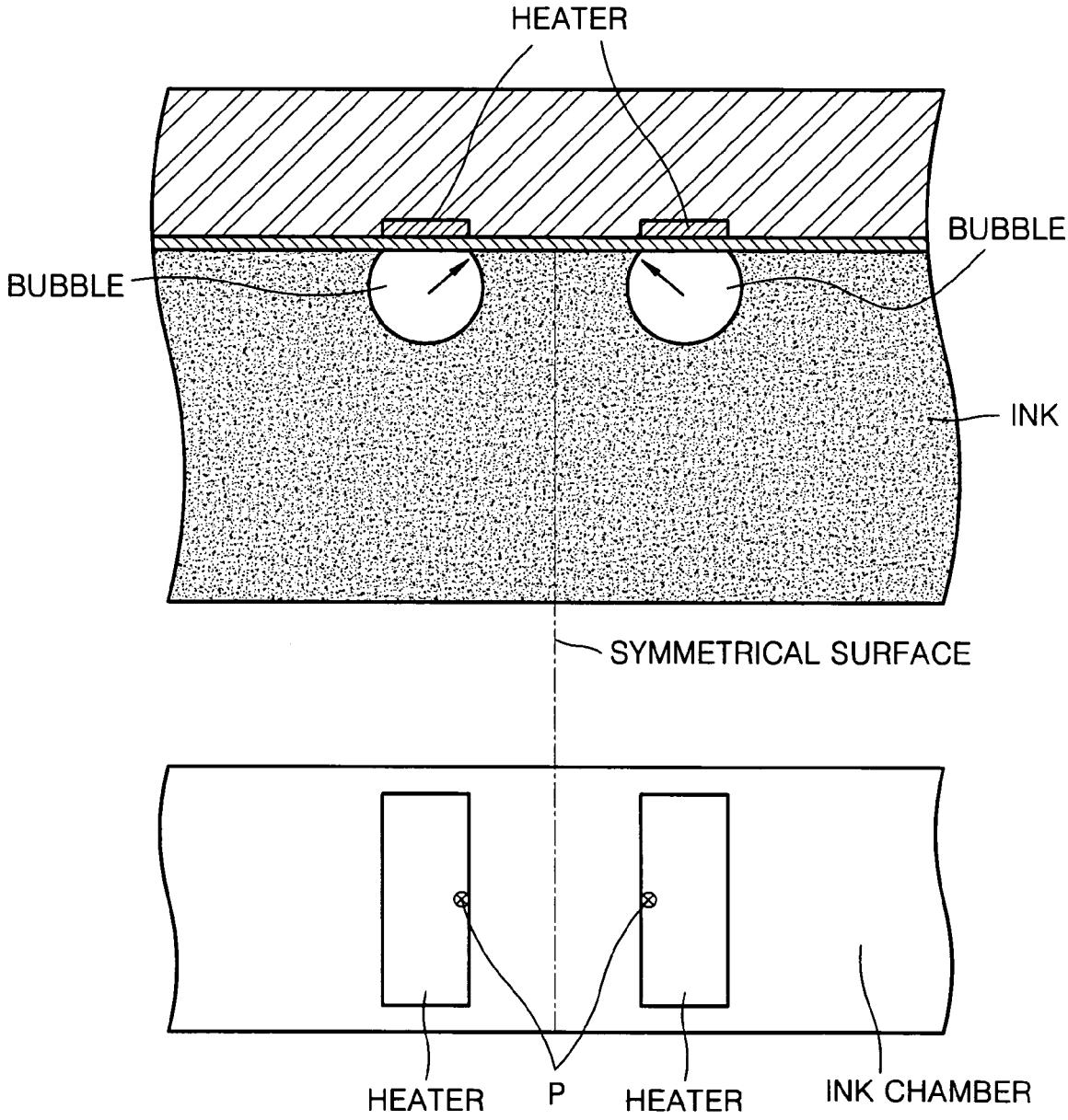
FIGS. 10A through 10C illustrate a state in which cavitation points move according to boundary conditions of an ink chamber, which serve to explain a principle concept of the present invention.
Figure 10B:
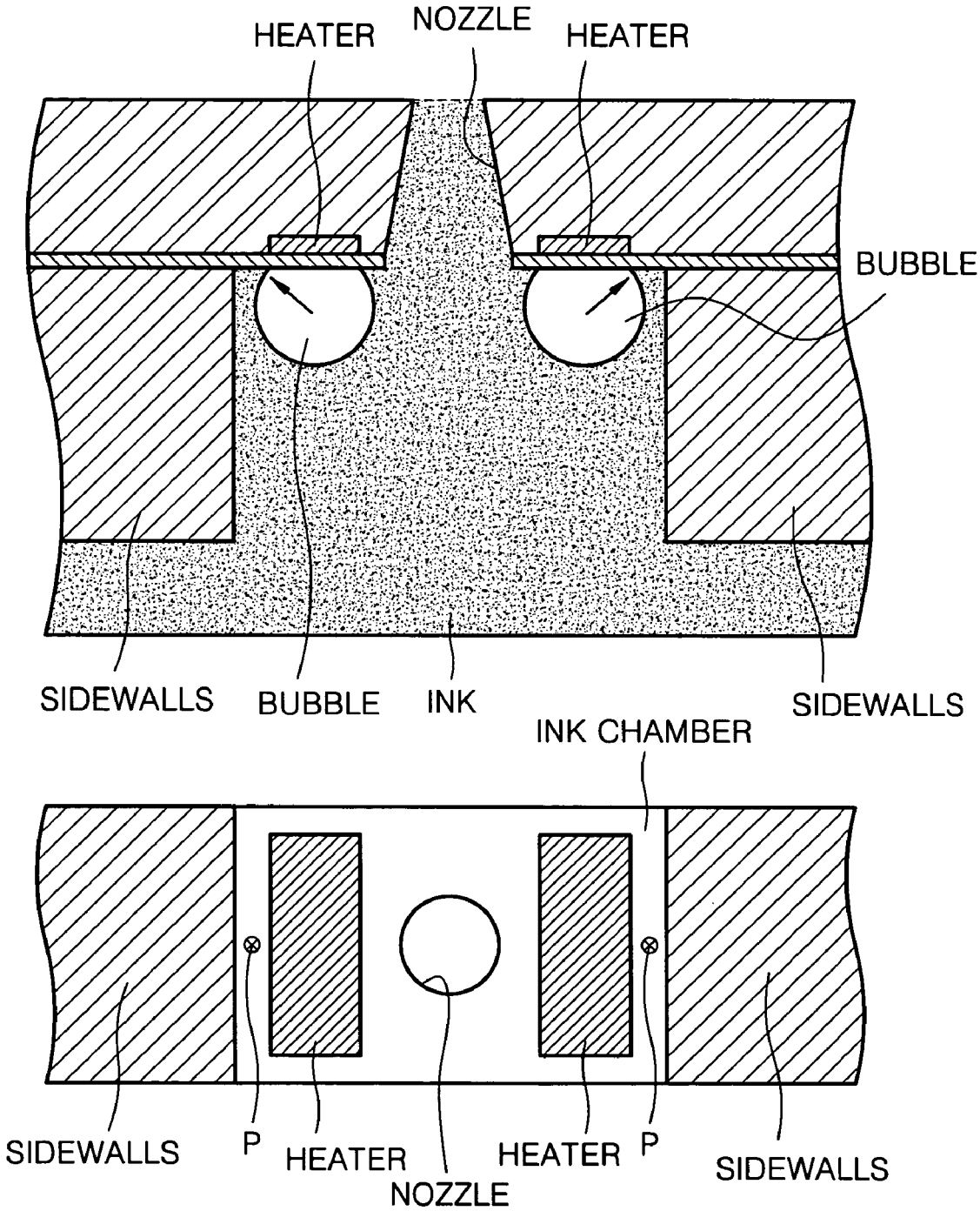
Figure 10C:
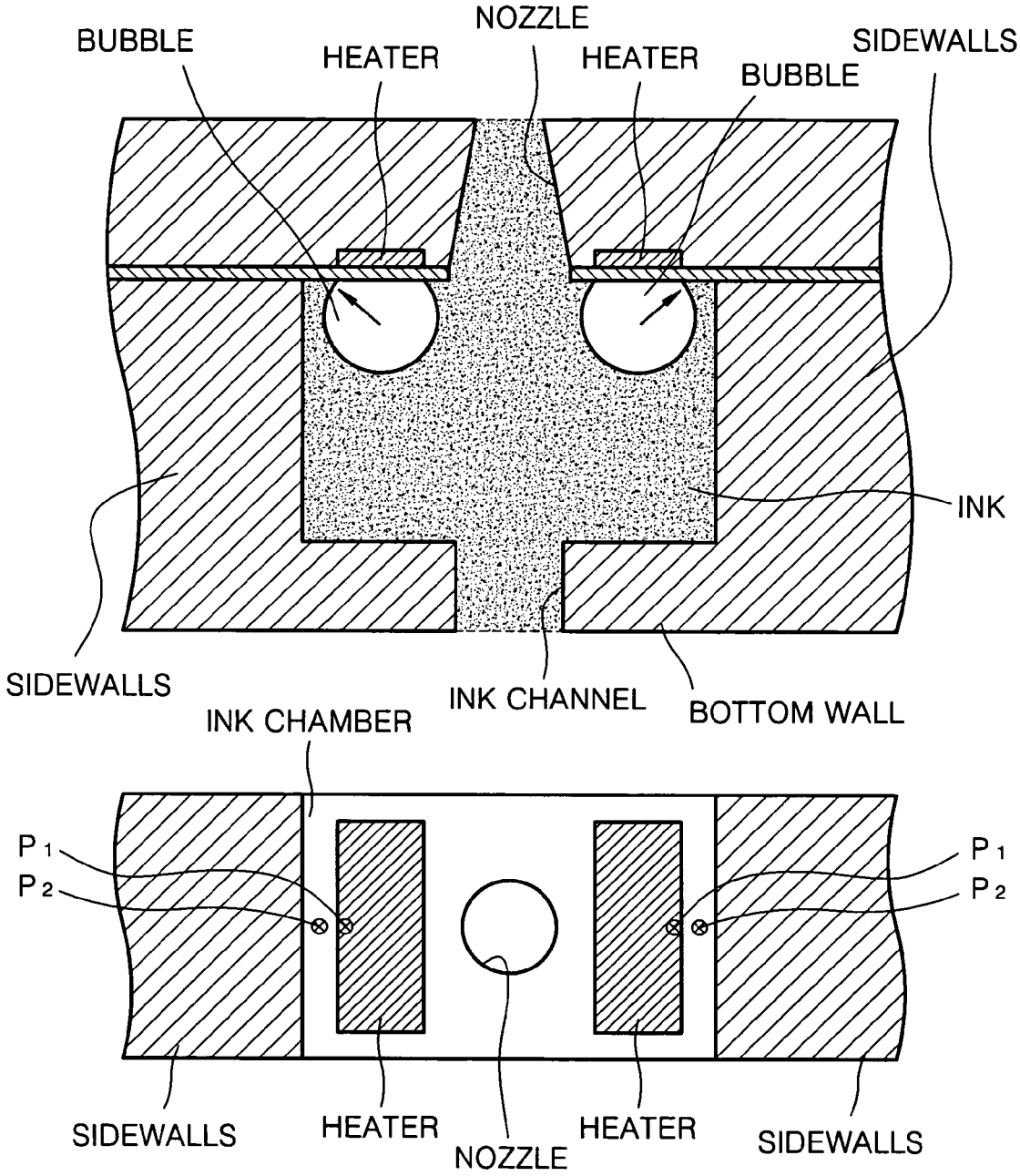

FIGS. 10A through 10C illustrate a state in which cavitation points move according to boundary conditions of an ink chamber, which serve to explain a principle concept of the present invention. Upper pictures of FIGS. 10A through 10C illustrate vertical cross-sectional views, and lower pictures of FIGS. 10A through 10C illustrate plan views.

FIG. 10A shows positions of the cavitation points when bubbles formed under two heaters collapse in an ink chamber having no nozzle and no sidewalls, but having a bottom wall. When the bubbles contract and collapse, since there is no restraint at a bottom surface and an outer side surface of each of the two bubbles, ink is smoothly supplied to the bubbles through the bottom surface and the outer side surface. However, ink is not smoothly supplied to the bubbles through adjacent side surfaces of the two bubbles. Specifically, a symmetrical surface between the two bubbles restrains the contraction of the bubbles. Thus, the two bubbles contract toward the symmetrical surface, i.e., in a direction indicated by arrows, and the cavitation points are located at points P at inner edges of the two heaters.

FIG. 10B shows positions of cavitation points when bubbles formed under two heaters collapse in an ink chamber having a nozzle and sidewalls, but no bottom wall. When the bubbles contract and collapse, since there is no restraint at a bottom surface of each of the two bubbles, ink is smoothly supplied to the bubbles through the bottom surface. Also, ink is comparatively smoothly supplied to the bubbles through adjacent side surfaces of the two bubbles from the nozzle. However, ink is not smoothly supplied to the bubbles through outer side surfaces of the two bubbles. Specifically, the sidewalls serve as a strong restraint on the contraction of the bubbles. Thus, the two bubbles contract toward the sidewalls, i.e., in a direction indicated by arrows, and the cavitation points are located at points P between the heaters and the sidewalls.

FIG. 10C shows positions of cavitation points where bubbles formed under the two heaters collapse in an ink chamber of an ink-jet printhead including sidewalls and a bottom wall surrounding the ink chamber, a nozzle above the ink chamber, and an ink channel at a center of the bottom wall of the ink chamber. In this structure, the sidewalls serve as the strongest restraint, and the bottom wall serves as a relatively strong restraint on the contraction of bubbles formed below two heaters. Thus, two bubbles contract toward the sidewalls, i.e., in a direction indicated by arrows, and cavitation points are located at points $P_1$ at outer edges of the two heaters.

If each of the sidewalls has a convex projection or a concave groove in accordance with the first embodiment of the present invention as described above, because the surface area of the sidewalls adjacent to the bubbles is large, the sidewalls serve as stronger restraints on the contraction of bubbles. Thus, since ink is not smoothly supplied to the bubbles through an area between the sidewalls and the bubbles, the cavitation points move beyond outer edges of the heaters toward the sidewalls, and are located at points $P_2$ between the heaters and the sidewalls.

In this way, substantially rectangular heaters are arranged at opposite sides of the nozzle so that the cavitation points move to outer edges of the heaters, and the inner surfaces of the sidewalls are uneven so that the cavitation points move beyond the heaters. Thus, since cavitation damage to the heaters is prevented, the lifespan of the printhead increases, and reliable, normal operation of the printhead can be extended. In addition, since a thick anticavitation layer is not required, ink in the ink chamber may be heated using less energy, and a driving frequency of the printhead may be increased.

Figure 11:
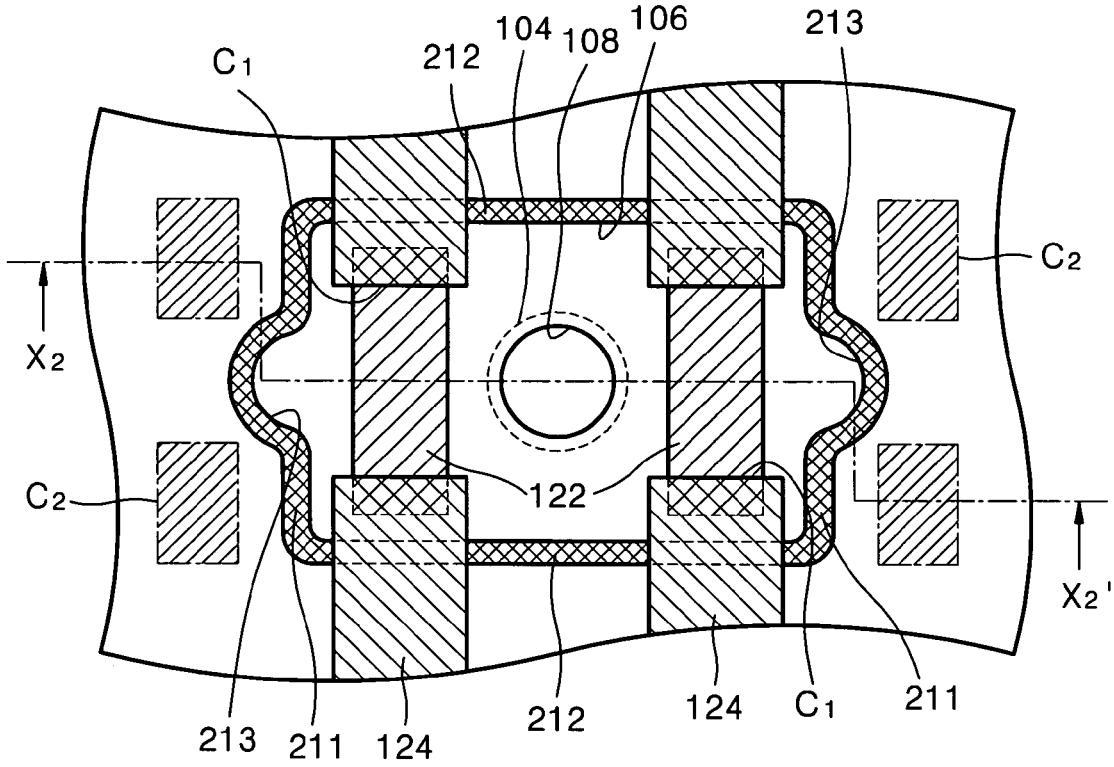
FIG. 11 illustrates a plan view of an ink-jet printhead according to a second embodiment of the present invention.
Figure 12:
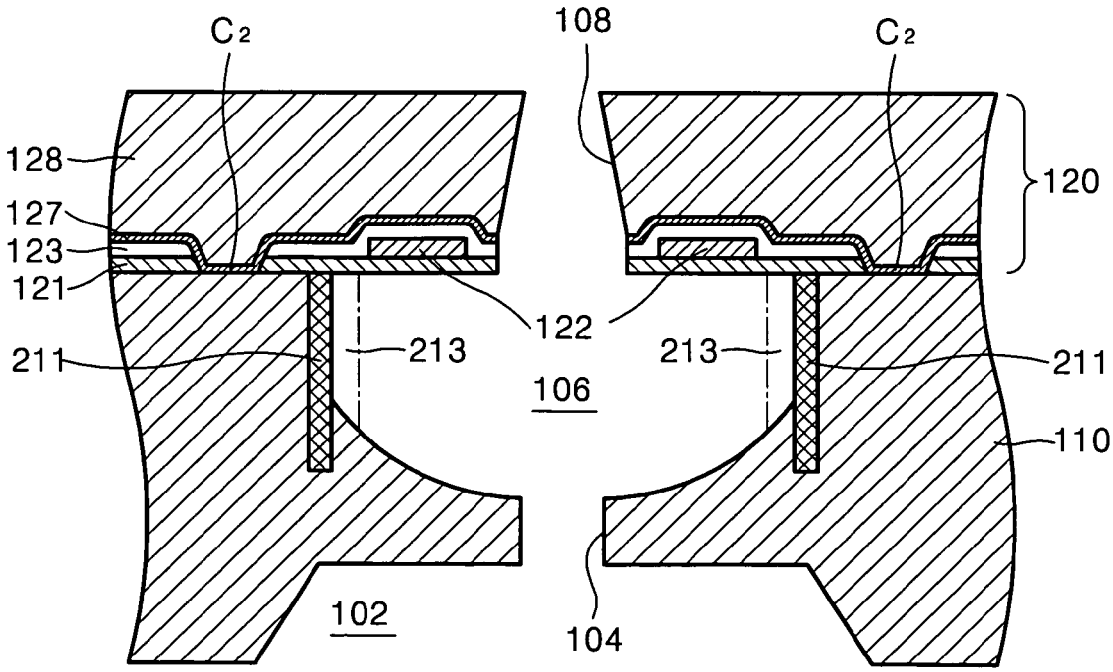
FIG. 12 illustrates a cross-sectional view of the ink-jet printhead taken along a line $X_2$–$X_2$' of FIG. 11.

FIG. 11 illustrates a plan view of an ink-jet printhead according to a second embodiment of the present invention. FIG. 12 illustrates a cross-sectional view of the ink-jet printhead taken along a line $X_2$–$X_2$' of FIG. 11.

Referring to FIGS. 11 and 12, the structure of the ink-jet printhead according to the second embodiment of the present invention is substantially the same as the structure of the printhead shown in FIG. 6, except for a shape of a first sidewall 211. Thus, only the shape and function of the first sidewall 211 will be described below.

The ink chamber 106 is defined by the first sidewall 211 and a second sidewall 212 to have a substantially rectangular shape. A pocket 213 of the ink chamber 106 is formed in each of the first sidewalls 211, which are formed in a widthwise direction of the ink chamber 106. The pocket 213 opens toward a center of the ink chamber 106. Due to the pocket 213, when bubbles formed below the heaters 122 contract and collapse, the resultant cavitation points move beyond outer edges of the heaters 122 toward the pocket 213 of the first sidewall 211.

Further, inner surfaces of the pocket 213 may be uneven, as in the first sidewalls 111 in the above-described first embodiment. Specifically, the pocket 213 may have a plurality of convex projections or concave grooves.

FIGS. 13A through 13D illustrate simplified views of the expansion and contraction of bubbles and positions of cavitation points in the ink-jet printhead shown in FIGS. 11 and 12.

Figure 13A:
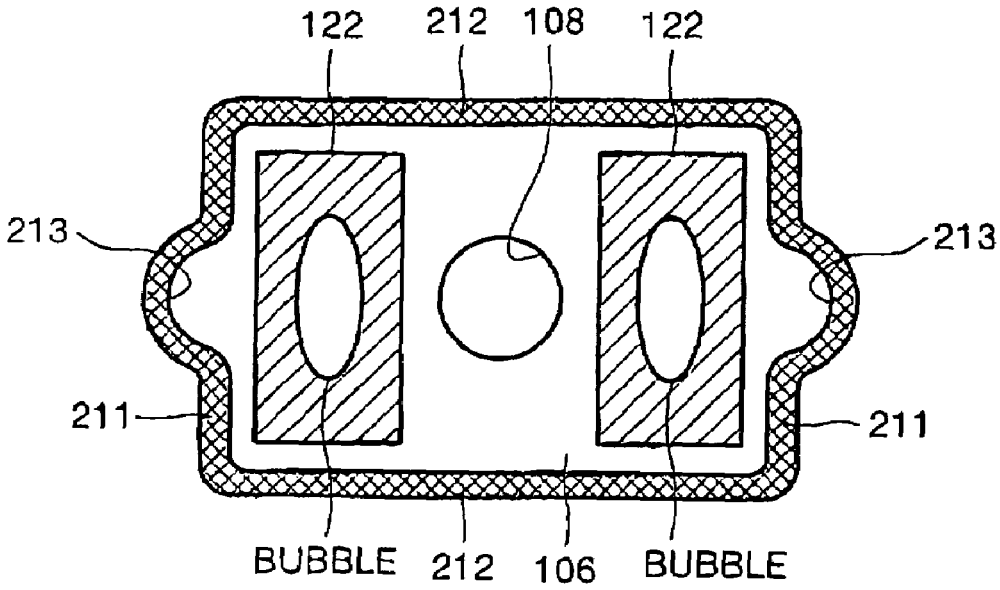
FIGS. 13A through 13D illustrate simplified views showing expansion and contraction of bubbles and positions of cavitation points in the ink-jet printhead shown in FIGS. 11 and 12.

Referring to FIG. 13A, when current is supplied to the heaters 122, ink in the ink chamber 106 is heated, and bubbles are generated below the heaters 122.

Figure 13B:
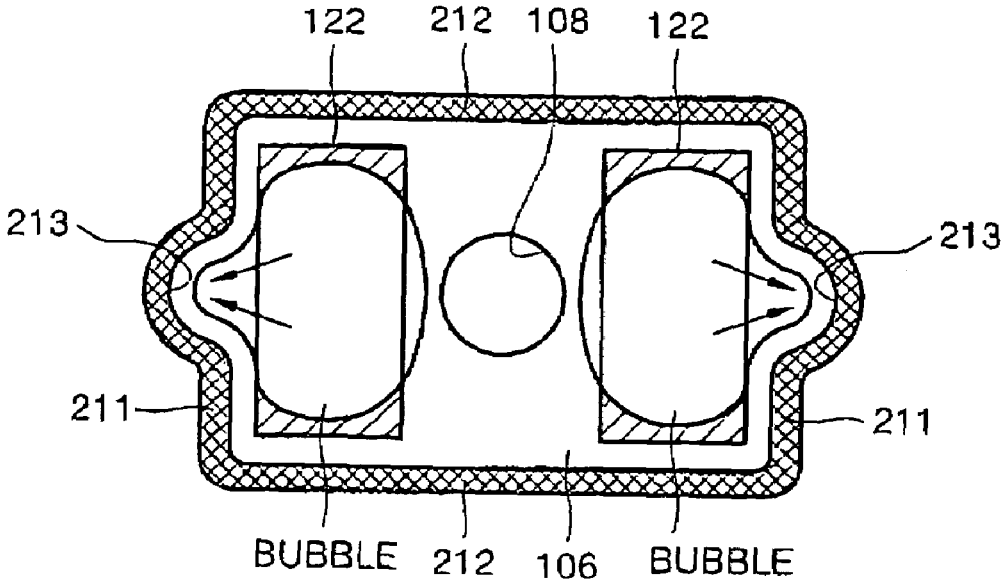

Referring to FIG. 13B, the bubbles generated below the heaters 122 grow due to a continuous supply of energy from the heaters 122. In this case, the bubbles convexly grow into the pockets 213 along the concave shape of the pockets 213.

Figure 13C:
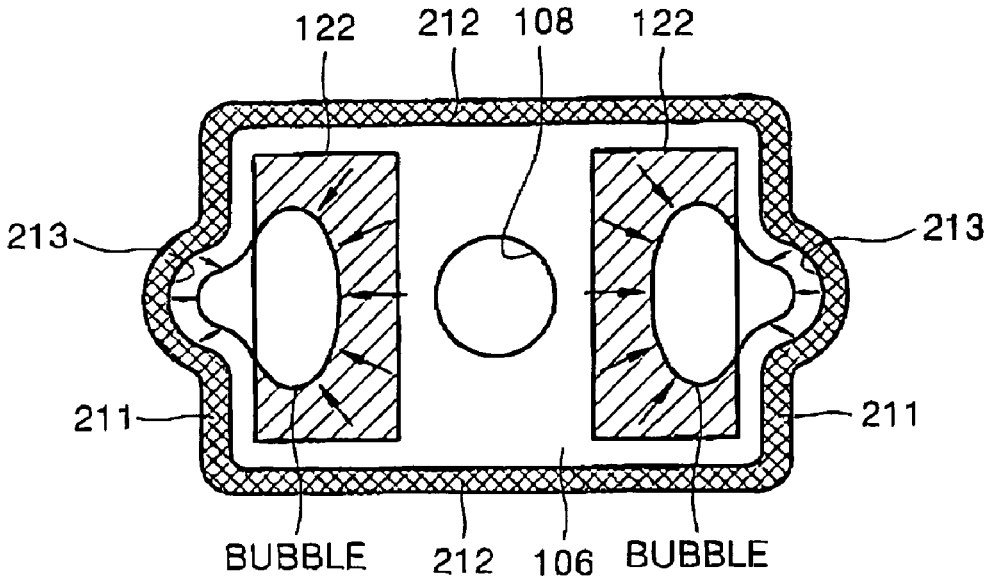

As shown in FIG. 13C, when the current supplied to the heaters 122 is cut off, the heaters 122 cool down, and the bubbles contract. In this case, ink is comparatively smoothly supplied at sides of the bubbles near the nozzle 108. However, ink is not smoothly supplied between the first sidewall 211 and the bubbles. Thus, the central points of the contracting bubbles gradually move toward the first sidewall 211.

Figure 13D:
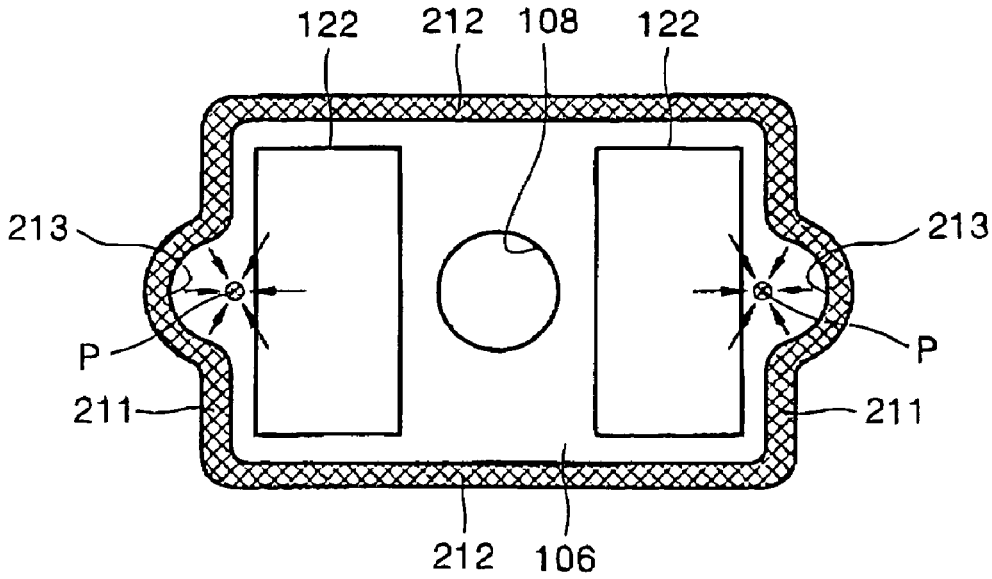

Referring to FIG. 13D, the central points of the contracting bubbles move to the first sidewall 211, points where the bubbles collapse, i.e., the cavitation points, are beyond the heaters 122 and are located at points P between the pockets 213 of the first sidewall 211 and the heaters 122. Thus, the cavitation damage to the heater can be prevented.

Figure 14:
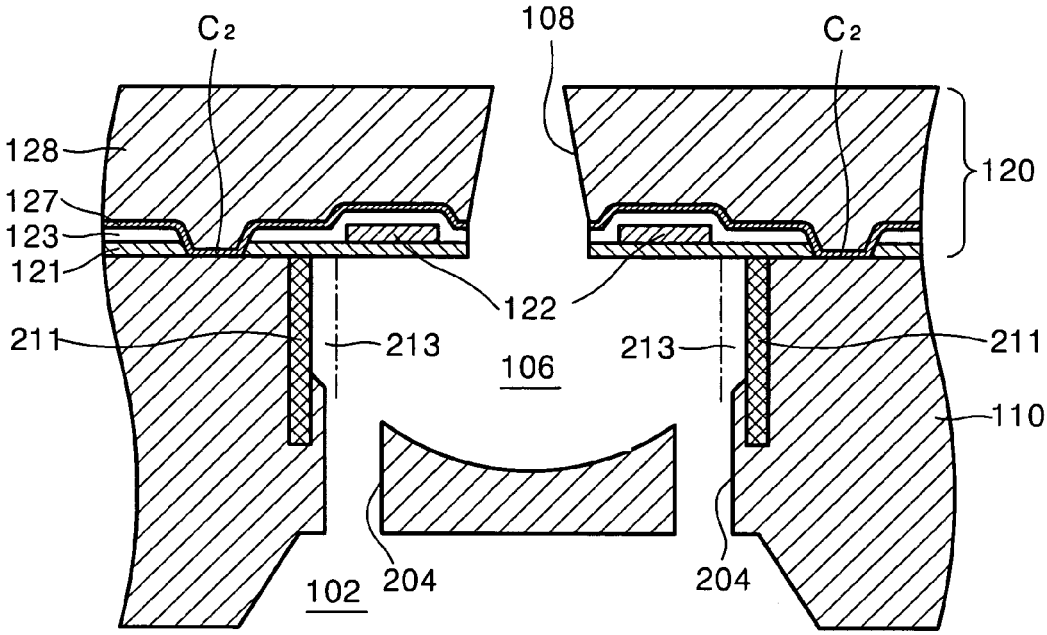
FIG. 14 illustrates a cross-sectional view showing an example of the structure of the ink-jet printhead shown in FIG. 12 in which two ink channels are formed.

FIG. 14 illustrates a cross-sectional view of an example of the structure of the ink-jet printhead shown in FIG. 12 in which two ink channels are formed.

Referring to FIG. 14, two ink channels 204 for providing flow communication between the ink chamber 106 and the manifold 102 are formed at a bottom of the ink chamber 106. Each of the two ink channels 204 are disposed adjacent to a first sidewall 211. In this case, ink is comparatively smoothly supplied by the ink channel 204 at the bottom surface of bubbles. Thus, as shown in FIG. 10B, restraint of the bottom wall on the contraction of the bubbles decreases. Thus, restraint of the first sidewall 211 on the contraction of the bubbles increases relative to the bottom wall. As a result, the cavitation points move closer to the first sidewall 211.

By forming ink channels 204 adjacent to the first sidewalls 211 and by forming the pocket 213, as described above, the cavitation points may be more reliably located beyond outer edges of the heaters 122.

Further, the above-described two ink channel configuration may be applied to the above-described first embodiment of the present invention.

Figure 15:
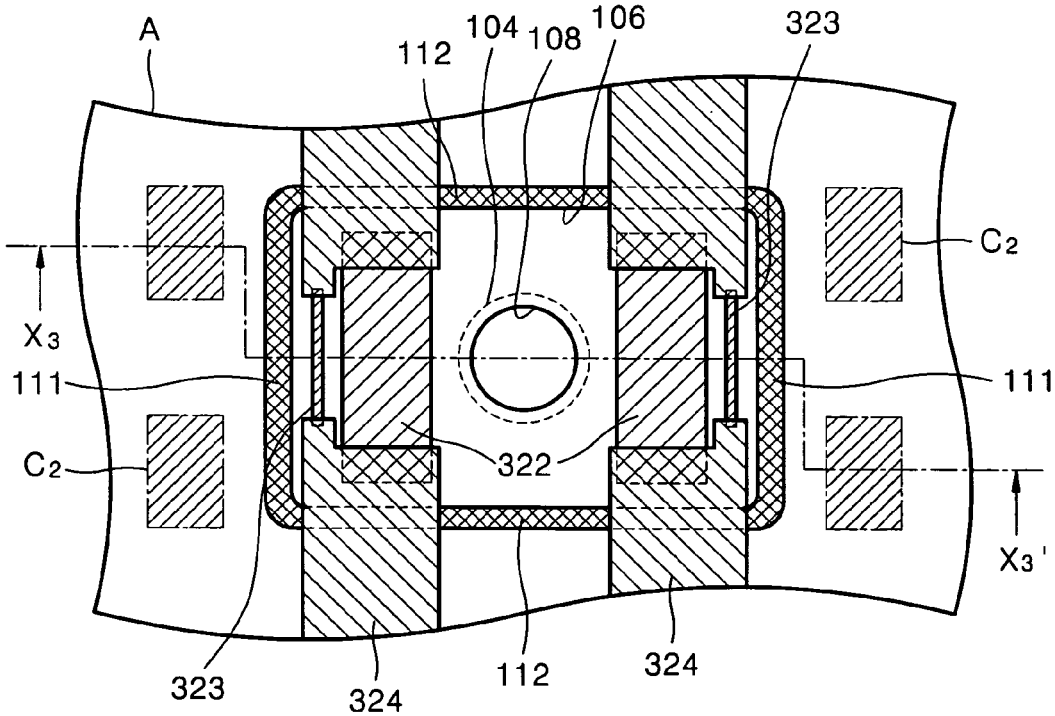
FIG. 15 illustrates a plan view of an ink-jet printhead according to a third embodiment of the present invention.
Figure 16:
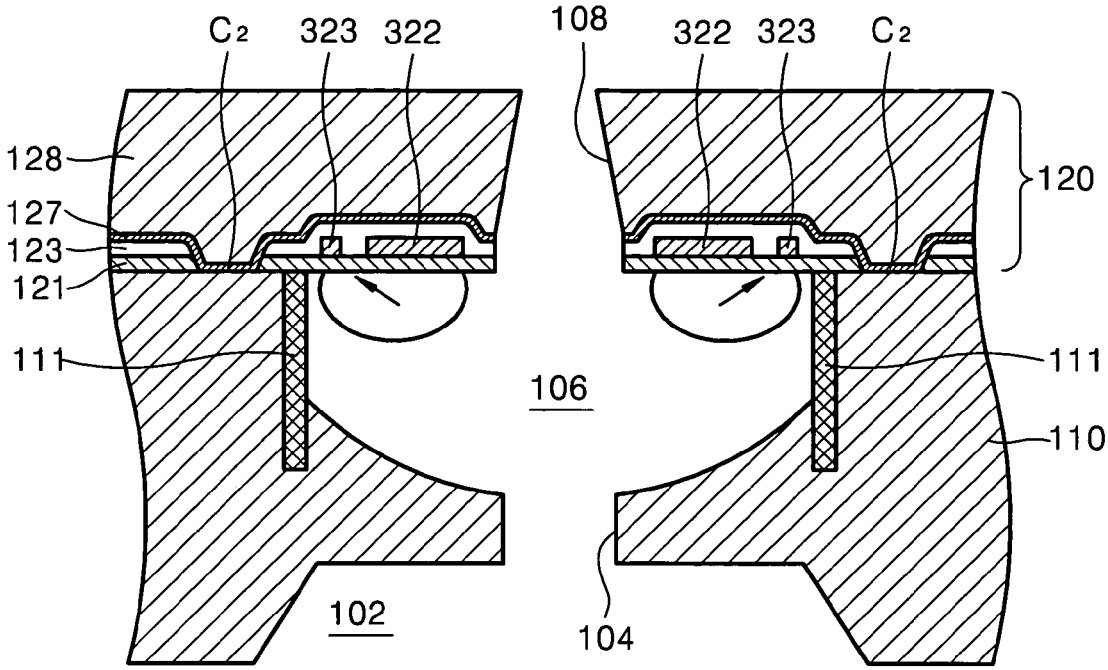
FIG. 16 illustrates a cross-sectional view of the ink-jet printhead taken along a line $X_3$–$X_3$' of FIG. 15.

FIG. 15 illustrates a plan view of an ink-jet printhead according to a third embodiment of the present invention. FIG. 16 illustrates a cross-sectional view of the ink-jet printhead taken along a line $X_3$–$X_3$' of FIG. 15 according to the third embodiment of the present invention.

Referring to FIGS. 15 and 16, the structure of the ink-jet printhead according to the third embodiment of the present invention is substantially the same as the structure of the ink-jet printhead shown in FIG. 6 according to the first embodiment of the present invention. The only difference between the first embodiment and the third embodiment is in that in the first embodiment, the first sidewall 111 has convex projections 113, which the third embodiment does not have, and the third embodiment further includes an auxiliary heater 323, which the first embodiment does not have, above the ink chamber 106 in addition to a main heater 322. Thus, this difference will be described below.

In the third embodiment, two main heaters 322 are disposed at opposite sides of the nozzle 108 above the ink chamber 106, which is defined by the first sidewalls 111 and the second sidewalls 112. Two auxiliary heaters 323 are disposed between each of the two main heaters 322 and a corresponding one of the first sidewalls 111 adjacent thereto. The main heaters 322 have a substantially rectangular shape having a longer length parallel to the first sidewalls 111. The auxiliary heaters 323 have a substantially rectangular shape and are disposed parallel to the main heaters 322. The main heaters 322 and the auxiliary heaters 323 may be formed of the same material as the material used to form the heaters according to the previously-described embodiments of the present invention.

One of the main heaters 322 and a corresponding one of the auxiliary heaters 323 are both connected to a conductor 324, so that a current may be simultaneously applied to the main heater 322 and the auxiliary heater 323. Dimensions of the auxiliary heater 323 are determined so that a resistance of the auxiliary heater 323 is the same as a resistance of the main heater 322. As a result, the main heater 322 and the auxiliary heater 323 generate heat simultaneously, and simultaneously generate a bubble below each of the main heater 322 and the auxiliary heater 323. In addition, a size of the auxiliary heater 323 and a distance between the auxiliary heater 323 and the main heater 322 are determined so that the cavitation points are located between the main heater 322 and the auxiliary heater 323.

An operation of the auxiliary heater 323 will now be described. When current is simultaneously applied to the main heater 322 and the auxiliary heater 323 via the conductor 324, bubbles are simultaneously generated below each of the main heater 322 and the auxiliary heater 323. The bubbles grow due to a continuous supply of energy, reach a critical size, and then unite. In this case, the central points of the united bubbles move toward the first sidewall 111 as compared to the central points of the bubbles generated below the main heater 322 alone. When the supplied current is cut off, the united bubbles contract toward the first sidewall 111, i.e., in a direction of arrows in FIG. 16, due to the effect of the first sidewall 111, and points where the bubbles collapse, that is, the cavitation points are beyond the outer edges of the main heater 322. Here, the cavitation points are located between the main heater 322 and the auxiliary heater 323. Thus, cavitation damage to the main heater 322 and the auxiliary heater 323 can be prevented.

Figure 17:
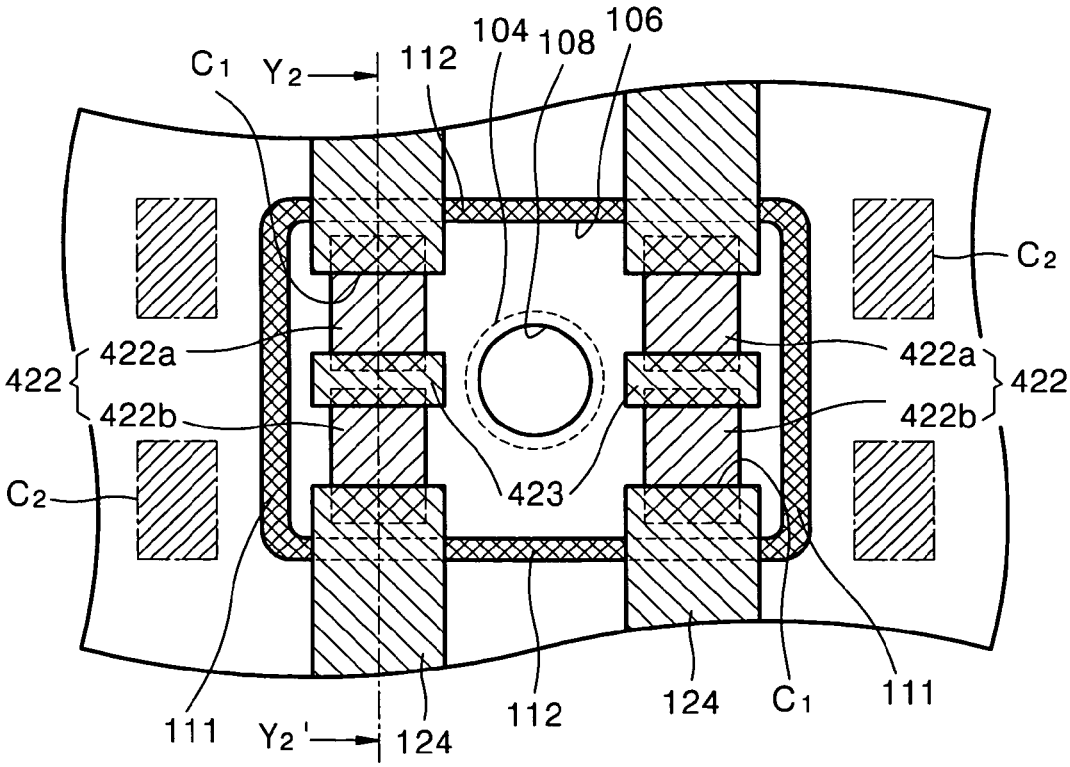
FIG. 17 illustrates a plan view of an ink-jet printhead according to a fourth embodiment of the present invention.
Figure 18:
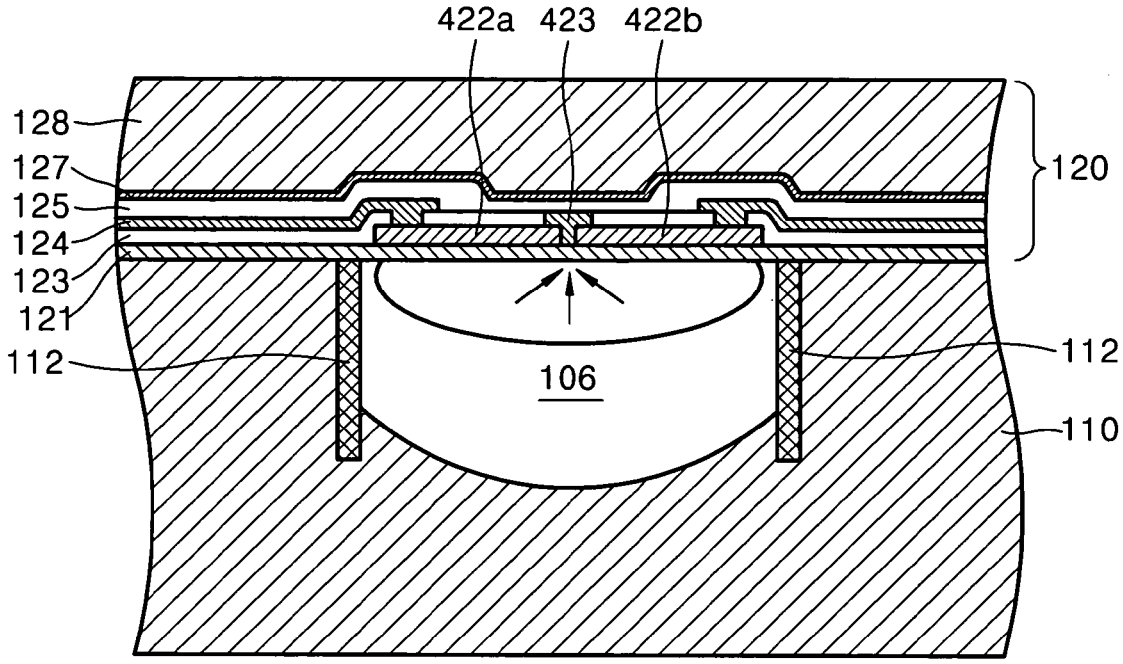
FIG. 18 illustrates a cross-sectional view of the ink-jet printhead taken along a line $Y_2$–$Y_2$' of FIG. 17.

FIG. 17 illustrates a plan view of an ink-jet printhead according to a fourth embodiment of the present invention. FIG. 18 illustrates a cross-sectional view of the ink-jet printhead taken along a line $Y_2$–$Y_2$' of FIG. 17.

Referring to FIGS. 17 and 18, the structure of the ink-jet printhead according to the fourth embodiment of the present invention is substantially the same as the structure of the ink-jet printhead shown in FIG. 6. The only difference between the first embodiment and the fourth embodiment is that in the first embodiment, the first sidewall 111 has convex projections 113, which the fourth embodiment does not have, and in the fourth embodiment, each of two heaters 422 disposed at opposite sides of the nozzle 108 is divided into two parts 422*a* and 422*b*, which is not the case in the first embodiment, and a metallic layer 423 is formed between the two parts 422*a* and 422*b*. Thus, this difference will be described below.

In the fourth embodiment, two heaters 422 are disposed at opposite sides of the nozzle 108 above the ink chamber 106 defined by the first sidewalls 111 and the second sidewalls 112. Each of the two heaters 422 may be divided into two parts 422*a* and 422*b* so that each part has a length that is one-half the length of the undivided heater 422. The first part 422*a* and the second part 422*b* are spaced a predetermined distance apart from each other, and the metallic layer 423 is formed therebetween. The metallic layer 423 serves to electrically connect the two parts 422*a* and 422*b* of the heater 422 and may be formed of the same material as the material used to form the conductor 124 connected to both ends of the heater 422.

When current is applied to the heater 422 via the conductor 124, bubbles are simultaneously generated below each of the two parts 422*a* and 422*b* of the heater 422. The bubbles grow due to a continuous supply of energy, reach a critical size, and then unite. In this case, the central points of the united bubbles are located between the first part 422*a* and the second part 422*b* of the heater 422. Specifically, the central points of the contracting bubbles do not move in a widthwise direction of the ink chamber 106, and the bubbles contract in a direction shown by arrows in FIG. 18. Thus, points where the bubbles collapse, i.e., the cavitation points, are located below the metallic layer 423 and between the first part 422*a* and the second part 422*b* of the heater 422. Thus, cavitation damage to the heater 422 can be prevented.

Figure 19:
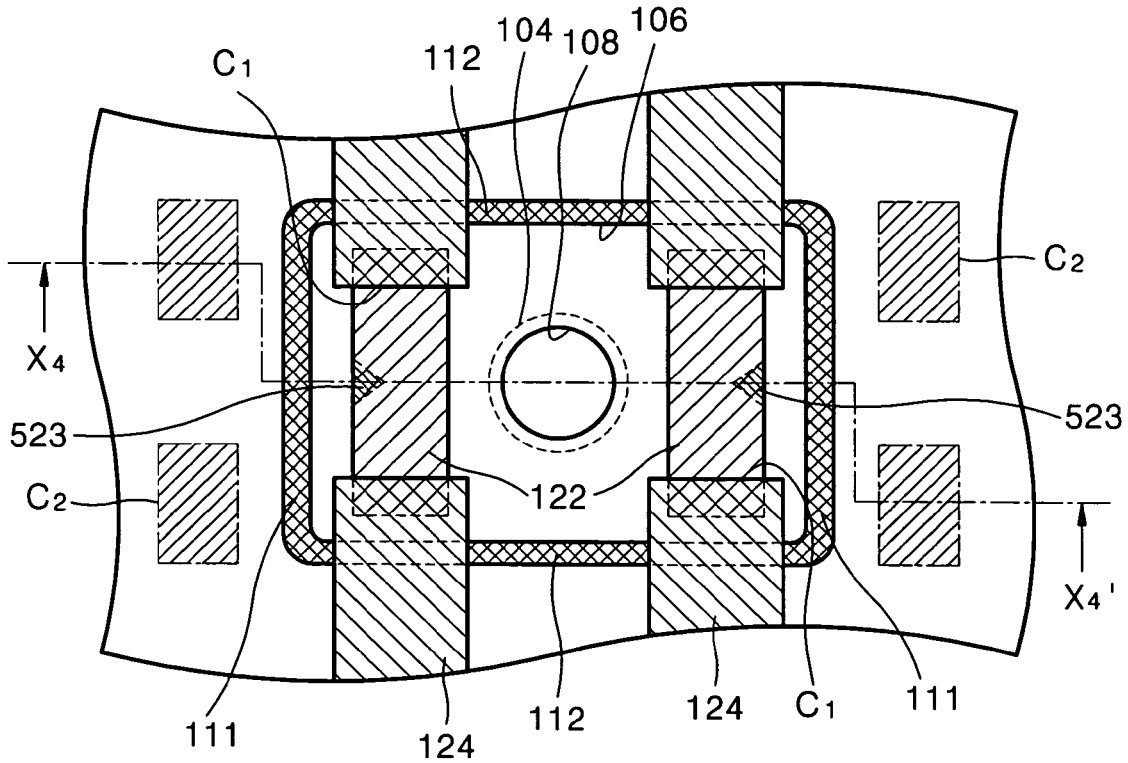
FIG. 19 illustrates a plan view of an ink-jet printhead according to a fifth embodiment of the present invention.
Figure 20:
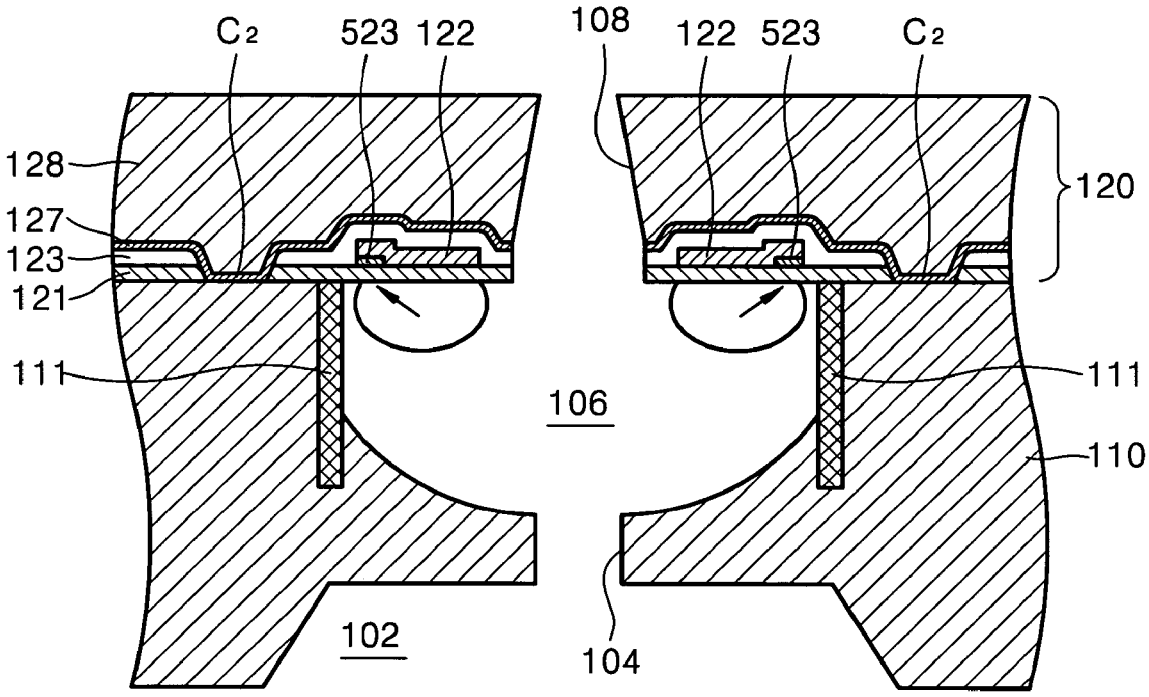
FIG. 20 illustrates a cross-sectional view of the ink-jet printhead taken along a line $X_4$–$X_4$' of FIG. 19.

FIG. 19 illustrates a plan view of an ink-jet printhead according to a fifth embodiment of the present invention. FIG. 20 illustrates a cross-sectional view of the ink-jet printhead taken along a line $X_4$–$X_4$' of FIG. 19.

Referring to FIGS. 19 and 20, the structure of the ink-jet printhead according to the fifth embodiment of the present invention is substantially the same as the structure of the ink-jet printhead shown in FIG. 6. The only difference between the first embodiment and the fifth embodiment is that in first embodiment, the first sidewall 111 has the convex projections 113, which the fifth embodiment does not have, and in the fifth embodiment, a metallic layer 523, which the first embodiment does not have, is formed on a bottom surface of each of two heaters 122 disposed at opposite sides of the nozzle 108. Thus, this difference will be described below.

In the fifth embodiment, two heaters 122 are disposed at opposite sides of the nozzle 108 above the ink chamber 106 defined by the first sidewalls 111 and the second sidewalls 112, and a metallic layer 523 is formed on the bottom surface of each of the two heaters 122. The metallic layer 523 is formed at an outer edge, i.e., away from the nozzle 108, of each the heaters 122, i.e., on a bottom surface of the lengthwise center of the outer edge of each of the heaters 122. The metallic layer 523 may be formed to have a wedge shape to minimize a decrease in an effective area of the heater 122.

When the heaters 122 are disposed at opposite sides of the nozzle 108, as described above, the cavitation points are located beyond the heaters 122 when bubbles contract and collapse. In the fifth embodiment, since the metallic layer 523 is formed at the cavitation points, the heaters 122 are protected by the metallic layer 523, and cavitation damage to the heaters 122 can be prevented.

As described above, a thermally-driven ink-jet printhead according to the present invention has the following several advantages.

First, cavitation damage to a heater may be prevented, thereby increasing a lifespan of the printhead and extending reliable, normal operations of the printhead.

Second, since a thick anticavitation layer is not required to be formed and an area of a heater does not need to be increased, ink in an ink chamber may be heated with less energy, thereby increasing a driving frequency of the printhead.

Third, a substantially rectangular ink chamber having an optimum size defined by sidewalls that serve as an etch stop may be formed such that a distance between adjacent nozzles is narrowed and an ink-jet printhead with high DPI that is capable of printing a high resolution image may be implemented.

Fourth, since a heat dissipating capability is improved by a heat dissipating layer formed of metal having a relatively large thickness, ejection performance is improved and a driving frequency is increased. In addition, a nozzle can be formed to have a sufficient length. Thus, a meniscus at the surface of ink in the nozzle can be maintained in the nozzle, an ink refill operation can be stably performed, and linearity of ink droplets ejected through the nozzle is improved.

Exemplary embodiments of the present invention have been disclosed herein and, although specific terms are employed, they are used and are to be interpreted in a generic and descriptive sense only and not for purpose of limitation. For example, the various features that are capable of moving cavitation points may be combined with one another. Specifically, the ink-jet printhead according to the present invention may include two or more of the above-described features, such as a first sidewall having uneven surfaces, a first sidewall having pockets, an auxiliary heater, a heater divided into two parts, and a metallic layer having a wedge shape. Materials used in forming each element of an ink-jet printhead according to the present invention may be varied. For example, a substrate may be formed of a material, other than silicon, which has a good processing property. Similarly, materials used to form sidewalls, a heater, a conductor, passivation layers, and a heat dissipating layer may be varied. In addition, methods for depositing and forming each element may be modified. Accordingly, it will be understood by those of ordinary skill in the art that various changes in form and details may be made without departing from the spirit and scope of the present invention as set forth in the following claims.

What is claimed is:

1. A thermally-driven ink-jet printhead, comprising:

a substrate having an ink chamber to be filled with ink to be ejected, a manifold for supplying ink to the ink chamber, and an ink channel for providing flow communication between the ink chamber and the manifold;

first sidewalls and second sidewalls, which are formed to a predetermined depth from an upper surface of the substrate and define the ink chamber to have a substantially rectangular shape, the first sidewalls being disposed in a widthwise direction of the ink chamber and the second sidewalls being disposed in a lengthwise direction of the ink chamber;

a nozzle plate formed on the substrate, the nozzle plate including a plurality of material layers, and a nozzle passing through the nozzle plate and in flow communication with the ink chamber;

a heater, which is disposed between the nozzle and one of the first sidewalls, the heater being disposed within the nozzle plate and positioned above the ink chamber;

a conductor, which is disposed within the nozzle plate, the conductor being electrically connected to the heater; and a shifting feature for moving cavitation points beyond an outer edge of the heater.

2. The thermally-driven ink-jet printhead as claimed in claim 1, wherein inner surfaces of each of the first sidewalls are uneven.

3. The thermally-driven ink-jet printhead as claimed in claim 2, further comprising a plurality of convex projections formed on the inner surfaces of each of the first sidewalls.

4. The thermally-driven ink-jet printhead as claimed in claim 2, further comprising a plurality of concave grooves formed on the inner surfaces of each of the first sidewalls.

5. The thermally-driven ink-jet printhead as claimed in claim 1, further comprising a pocket formed in each of the first sidewalls.

6. The thermally-driven ink-jet printhead as claimed in claim 5, wherein inner surfaces of the pocket are uneven.

7. The thermally-driven ink-jet printhead as claimed in claim 6, further comprising a plurality of convex projections formed on the inner surfaces of each of the first sidewalls.

8. The thermally-driven ink-jet printhead as claimed in claim 6, further comprising a plurality of concave grooves formed on the inner surfaces of each of the first sidewalls.

9. The thermally-driven ink-jet printhead as claimed in claim 1, wherein the heater comprises:

a main heater, which is disposed between the nozzle and one of the first sidewalls, the main heater being disposed within the nozzle plate and positioned above the ink chamber; and an auxiliary heater, which is disposed between the main heater and a corresponding one of the first sidewalls, wherein the conductor, which is disposed within the nozzle plate, is electrically connected to the main heater and the auxiliary heater.

10. The thermally-driven ink-jet printhead as claimed in claim 9, wherein a size of the auxiliary heater and a distance between the auxiliary heater and the main heater are determined so that cavitation points are located between the main heater and the auxiliary heater.

11. The thermally-driven ink-jet printhead as claimed in claim 9, wherein the main heater and the auxiliary heater have a substantially rectangular shape in which a length of the ink chamber extends in a nozzle disposition direction.

12. The thermally-driven ink-jet printhead as claimed in claim 9, wherein dimensions of the auxiliary heater are determined so that a resistance of the auxiliary heater is the same as a resistance of the main heater.

13. The thermally-driven ink-jet printhead as claimed in claim 9, wherein the main heater and the auxiliary heater are both connected to the conductor.

14. The thermally-driven ink-jet printhead as claimed in claim 1, wherein the heater has a substantially rectangular shape in which a length of the ink chamber extends in a nozzle disposition direction.

15. The thermally-driven ink-jet printhead as claimed in claim 1, wherein the ink channel comprises two ink channels, each of the two ink channel being formed adjacent to one of the first sidewalls.

16. The thermally-driven ink-jet printhead as claimed in claim 1, wherein the first sidewalls and the second sidewalls define the ink chamber to have a substantially rectangular shape in which a width of the ink chamber extends in a nozzle disposition direction.

17. The thermally-driven ink-jet printhead as claimed in claim 1, wherein the first sidewalls and the second sidewalls are formed of materials other than a material used to form the substrate.

18. The thermally-driven ink-jet printhead as claimed in claim 17, wherein the first sidewalls and the second sidewalls are silicon oxide.

19. The thermally-driven ink-jet printhead as claimed in claim 1, wherein the nozzle plate comprises:

a plurality of passivation layers stacked on the substrate; and a heat dissipating layer stacked on the plurality of passivation layers, the heat dissipating layer being formed of a material having good thermal conductivity.

20. The thermally-driven ink-jet printhead as claimed in claim 19, wherein the plurality of passivation layers are formed of an insulating material.

21. The thermally-driven ink-jet printhead as claimed in claim 19, wherein the heater and the conductor are formed between adjacent layers of the plurality of passivation layers.

22. The thermally-driven ink-jet printhead as claimed in claim 19, wherein the nozzle has a tapered shape such that a diameter thereof decreases in a direction toward an outlet.

23. The thermally-driven ink-jet printhead as claimed in claim 19, wherein the heat dissipating layer is formed of at least one material selected from the group consisting of nickel (Ni), copper (Cu), aluminum (Al), and gold (Au).

24. The thermally-driven ink-jet printhead as claimed in claim 19, wherein the heat dissipating layer is formed to a thickness of about 10–100 μm.

25. The thermally-driven ink-jet printhead of claim 19, wherein the heat dissipating layer thermally contacts an upper surface of the substrate through a contact hole formed in the plurality of passivation layers.

26. The thermally-driven ink-jet printhead as claimed in claim 19, further comprising a seed layer, for electroplating the heat dissipating layer, formed on the plurality of passivation layers.

27. The thermally-driven ink-jet printhead as claimed in claim 26, wherein the seed layer is formed of at least one material selected from the group consisting of copper (Cu), chromium (Cr), titanium (Ti), gold (Au), and nickel (Ni).

28. A thermally-driven ink-jet printhead, comprising:

a substrate having an ink chamber to be filled with ink to be ejected, a manifold for supplying ink to the ink chamber, and an ink channel for providing flow communication between the ink chamber and the manifold;

first sidewalls and second sidewalls, which are formed to a predetermined depth from an upper surface of the substrate and define the ink chamber to have a substantially rectangular shape, the first sidewalls being disposed in a widthwise direction of the ink chamber and the second sidewalls being disposed in a lengthwise direction of the ink chamber;

a nozzle plate formed on the substrate, the nozzle plate including a plurality of material layers, and a nozzle passing through the nozzle plate and in flow communication with the ink chamber;

a heater, which is disposed between the nozzle and one of the first sidewalls, the heater being disposed within the nozzle plate and positioned above the ink chamber;

a conductor, which is disposed within the nozzle plate, the conductor being electrically connected to the heater; and means for moving cavitation points beyond an outer edge of the heater.

29. The thermally-driven ink-jet printhead as claimed in claim 28, wherein the means for moving cavitation points beyond an outer edge of the heater comprise inner surfaces of each of the first sidewalls being uneven.

30. The thermally-driven ink-jet printhead as claimed in claim 29, further comprising a plurality of convex projections formed on the inner surfaces of each of the first sidewalls.

31. The thermally-driven ink-jet printhead as claimed in claim 29, further comprising a plurality of concave grooves formed on the inner surfaces of each of the first sidewalls.

32. The thermally-driven ink-jet printhead as claimed in claim 28, wherein the means for moving cavitation points beyond an outer edge of the heater comprise a pocket formed in each of the first sidewalls.

33. The thermally-driven ink-jet printhead as claimed in claim 32, wherein inner surfaces of the pocket are uneven.

34. The thermally-driven ink-jet printhead as claimed in claim 33, further comprising a plurality of convex projections formed on the inner surfaces of each of the first sidewalls.

35. The thermally-driven ink-jet printhead as claimed in claim 33, further comprising a plurality of concave grooves formed on the inner surfaces of each of the first sidewalls.

36. The thermally-driven ink-jet printhead as claimed in claim 28, wherein the means for moving cavitation points beyond an outer edge of the heater comprises providing a heater including:

a main heater, which is disposed between the nozzle and one of the first sidewalls, the main heater being disposed within the nozzle plate and positioned above the ink chamber; and an auxiliary heater, which is disposed between the main heater and a corresponding one of the first sidewalls, wherein the conductor, which is disposed within the nozzle plate, is electrically connected to the main heater and the auxiliary heater.

37. The thermally-driven ink-jet printhead as claimed in claim 36, wherein a size of the auxiliary heater and a distance between the auxiliary heater and the main heater are determined so that cavitation points are located between the main heater and the auxiliary heater.

38. The thermally-driven ink-jet printhead as claimed in claim 36, wherein the main heater and the auxiliary heater have a substantially rectangular shape in which a length of the ink chamber extends in a nozzle disposition direction.

39. The thermally-driven ink-jet printhead as claimed in claim 36, wherein dimensions of the auxiliary heater are determined so that a resistance of the auxiliary heater is the same as a resistance of the main heater.

40. The thermally-driven ink-jet printhead as claimed in claim 36, wherein the main heater and the auxiliary heater are both connected to the conductor.

* * * * *